US010801268B2

(12) United States Patent
Rahmani et al.

(10) Patent No.: US 10,801,268 B2
(45) Date of Patent: Oct. 13, 2020

(54) DOWNHOLE DRILL BIT WITH BALANCED CUTTING ELEMENTS AND METHOD FOR MAKING AND USING SAME

(71) Applicant: National Oilwell DHT, L.P., Houston, TX (US)

(72) Inventors: Reza Rahmani, Spring, TX (US); Alejandro Castillo, Conroe, TX (US)

(73) Assignee: National Oilwell DHT, L.P., Houston, TX (US)

( * ) Notice: Subject to any disclaimer, the term of this patent is extended or adjusted under 35 U.S.C. 154(b) by 318 days.

(21) Appl. No.: 15/761,918

(22) PCT Filed: Sep. 21, 2016

(86) PCT No.: PCT/US2016/052951

§ 371 (c)(1),
(2) Date: Mar. 21, 2018

(87) PCT Pub. No.: WO2017/053475

PCT Pub. Date: Mar. 30, 2017

(65) Prior Publication Data

US 2018/0291690 A1 Oct. 11, 2018

Related U.S. Application Data

(60) Provisional application No. 62/221,457, filed on Sep. 21, 2015.

(51) Int. Cl.
*E21B 10/567* (2006.01)
*E21B 10/42* (2006.01)

(52) U.S. Cl.
CPC ..... *E21B 10/5673* (2013.01); *E21B 10/42* (2013.01)

(58) Field of Classification Search
CPC ..... E21B 10/56; E21B 10/567; E21B 10/5673
See application file for complete search history.

(56) References Cited

U.S. PATENT DOCUMENTS 6,045,440 A 4/2000 Johnson et al.
6,302,224 B1 * 10/2001 Sherwood, Jr. ..... E21B 10/573 175/397

(Continued)

OTHER PUBLICATIONS

Rahmani, Reza, et al., New Quantitative, Analytical Approach Provides Rapid Identification and Diagnosis of Dysfunctional Bit Performance, SPE/IADC Drilling Conference and Exhibition, Mar. 17, 2015 (13 Pages).

(Continued)

*Primary Examiner* — Shane Bomar
(74) *Attorney, Agent, or Firm* — Conley Rose, P.C.

(57) ABSTRACT

A drill bit with individually-balanced cutting elements. The working surface of the cutters includes a balancing feature, such as an elongate ridge, and a balancing line that extends along the length of the feature, and through the center of the working surface. The cutters are positioned in the bit so that the working surface of each cutter removes formation material in an area of cut, and so that the cutter's balancing line passes through a centroid of its area of cut. A method for making a bit with individually-balanced cutters includes positioning cutters in the bit so that a cutter's balancing line passes through a selected centroid of the cutter's area of cut.

22 Claims, 28 Drawing Sheets

(56) References Cited

U.S. PATENT DOCUMENTS

| | | | | |
|---|---|---|---|---|
| 7,681,673 | B2 | 3/2010 | Kolachalam | |
| 7,726,420 | B2 | 6/2010 | Shen et al. | |
| 8,590,644 | B2 * | 11/2013 | Hall | E21B 10/43 175/426 |
| 9,145,742 | B2 * | 9/2015 | Hall | E21B 10/43 |
| 9,428,966 | B2 * | 8/2016 | Patel | E21B 10/55 |
| 10,590,710 | B2 * | 3/2020 | Vempati | E21B 10/42 |
| 2008/0035387 | A1 | 2/2008 | Hall | |
| 2009/0223721 | A1 * | 9/2009 | Dourfaye | E21B 10/42 175/426 |
| 2012/0247834 | A1 | 10/2012 | Buxbaum et al. | |
| 2013/0112485 | A1 | 5/2013 | Richert et al. | |
| 2013/0199856 | A1 | 8/2013 | Bilen et al. | |
| 2013/0292188 | A1 * | 11/2013 | Bilen | E21B 10/5676 175/428 |

OTHER PUBLICATIONS

Extended European Search report for EP Application 16849538.0 dated Apr. 8, 2019 (9 pages).

International Patent Application No. PCT/US2016/052951International Search Report and Written Opinion dated Dec. 15, 2016 (17 pages).

European Patent Application No. 16849538.0 examination report dated Mar. 3, 2020 (4 pages).

* cited by examiner

FIG. 3A
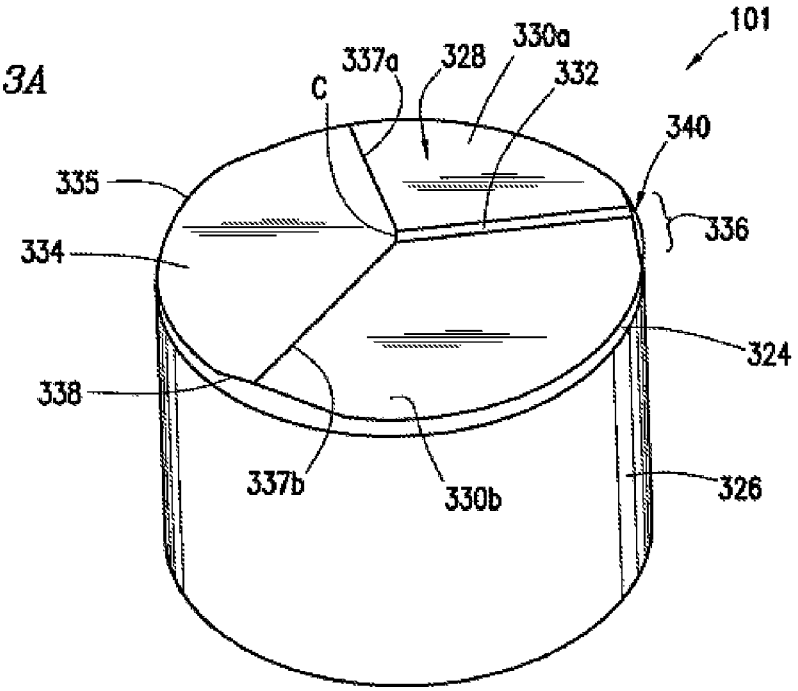
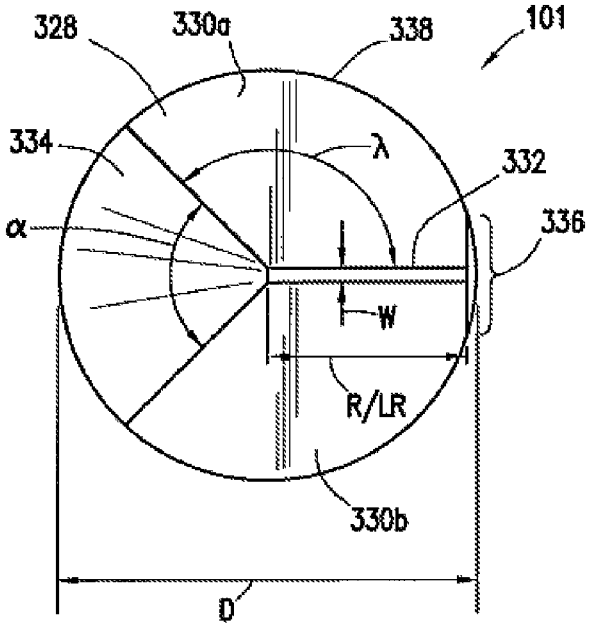
FIG. 3B
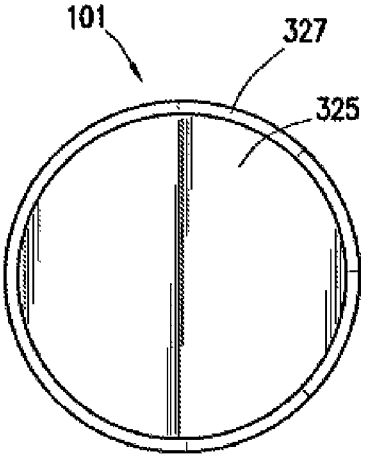
FIG. 3C

DOWNHOLE DRILL BIT WITH BALANCED CUTTING ELEMENTS AND METHOD FOR MAKING AND USING SAME

CROSS REFERENCE TO RELATED APPLICATIONS

This application is a 35 U.S.C § 371 national stage entry of PTC/US2016/052951, filed Sep. 21, 2016, entitled "Downhole Drill Bit With Balanced Cutting Elements And Method For Making And Using Same," which claims the benefit of US Provisional Application No. 62/221,457, filed Sep. 21, 2015, entitled "Downhole Drill Bit With Balanced Cutting Elements And Method For Making And Using Same," the entire contents of each being hereby incorporated by reference herein for all purposes.

BACKGROUND

This present disclosure relates generally to drilling equipment used in wellsite operations. More specifically, the present disclosure relates to drill bits and cutting elements used for drilling wellbores.

Various oilfield operations may be performed to locate and gather valuable downhole fluids. Oil rigs are positioned at well sites and downhole tools, such as drilling tools, are deployed into the ground to reach subsurface reservoirs. The drilling tools may include a drill string with a bottom hole assembly, and a drill bit advanced into the earth to form a wellbore. The drill bit may be connected to a downhole end of the bottom hole assembly and driven by drill string rotation from surface and/or by mud flowing through the drilling tool.

The drill bit may be a fixed cutter drill bit with polycrystalline diamond compact (PDC) cutting elements. An example of a drill bit and/or cutting element is provided in U.S. Application No. 61/694,652, filed Aug. 29, 2012, entitled Cutting Element for a Rock Drill Bit, published in WO 2014/036283, Mar. 6, 2014, the entire contents of which are hereby incorporated by reference herein. Other examples of drill bits and/or cutting elements are provided in WO2012/056196, WO2012/012774, and US Patent Application Nos. 2012/0018223, 201110031028, 201110212303, 2012/0152622, and/or 2010/0200305, the entire contents of which are hereby incorporated by reference herein.

Drilling performance is many times compromised when a drill bit is poorly balanced or becomes unbalanced during use. Unbalanced conditions can result in bit "whirl" where the bit does not rotate about its center, leading to out of round holes, sever bit damage, and loss of acceptable penetration rates. Beyond the drill bit itself, such unbalanced conditions can result in very severe vibration throughout the drill string and may impart large and damaging shocks as the bit and bottom hole assembly impact the borehole wall. Such shocks can damage sensitive and highly sophisticated electronics. Further, any of these conditions can require the very costly and time consuming effort to remove the drill string (which may be miles long) from the hole in order to replace the bit. Attempts to design and build balanced bits have centered on such factors as adjusting the placement of the cutting elements with respect to the position of neighboring or redundant cutters, adjusting the back and side rakes of the individual cutting elements, and adjusting the exposure height of the cutters. Additional and/or better means to design and manufacture balanced bits would be welcomed by the drilling industry.

SUMMARY OF THE DISCLOSURE

In at least one aspect, the disclosure relates to a cutting element for a drill bit advanceable into a subterranean formation to form a wellbore. The cutting element includes an element body having a face at an end thereof, and a ridge. The face has a ramp and a pair of side regions thereon. The ramp has a curved edge along a periphery of the face and two sides. Each of the two sides extends from opposite ends of the curved edge and converges at a location along the face. The face has a chamfer along a peripheral edge thereof. The ridge is between the chamfer and the location. Each of the pair of side regions is positioned on opposite sides of the ridge and extends between the periphery, the ridge, and one of the two sides of the ramp whereby the chamfer engages a wall of the wellbore and extrudate is drawn along the pair of side regions.

The element body may include a substrate, and/or a diamond layer with the face positioned along a surface of the diamond layer. A ramp angle may be defined between the sides of the ramp (e.g., at about 60 to 90 degrees). A surface angle may be defined along the side regions between the ridge and one of the two sides of the ramp (e.g., at about 135 degrees). A chamfer angle may be defined between a horizontal line and a face of the chamfer (e.g., at about 45 degrees). The ramp and the sides may incline along the periphery, such as at an angle of about 10 degrees. The ramp and/or the side regions may be flat and/or have a curved surface.

The location may be positioned about a center of the face or a distance therefrom. The sides may be along a radius of the face. The ridge may be along a radius of the face. The ridge may have a width of 0.40 mm, and/or a height of 0.30 mm. The ridge may have a length 112 of a diameter of the face, or less than ½ of a diameter of the face. The ridge may have a width that narrows or widens away from a center of the face. The chamfer may extend along the periphery between 10 and 360 degrees of the periphery of the face. The chamfer may define a leading edge of the cutting element for engagement with a wall of the wellbore. A bottom of the element body opposite the face has a bevel.

In another aspect, the drill bit is advanceable into a subterranean formation to form a wellbore. The drill bit includes a bit body and at least one cutting element disposable in the bit body. The cutting element includes an element body having a face at an end thereof, and a ridge. The face has a ramp and a pair of side regions thereon. The ramp has a curved edge along a periphery of the face and two sides. Each of the two sides extends from opposite ends of the curved edge and converges at a location along the face. The face has a chamfer along a peripheral edge thereof. The ridge is between the chamfer and the location. Each of the pair of side regions is positioned on opposite sides of the ridge and extends between the periphery, the ridge, and one of the two sides of the ramp whereby the chamfer engages a wall of the wellbore and extrudate is drawn along the pair of side regions.

The bit body may have ribs extending radially therefrom, and/or at least one socket to receive the cutting element therein.

Finally, in another aspect, the disclosure relates to a method of advancing a drill bit into a subterranean formation to form a wellbore. The method involves providing the drill bit with at least one cutting element. The cutting element includes an element body having a face at an end thereof, and a ridge. The face has a ramp and a pair of side regions thereon. The ramp has a curved edge along a periphery of the face and two sides. Each of the two sides extends from opposite ends of the curved edge and converges at a location along the face. The face has a chamfer along a peripheral edge thereof. The ridge is between the chamfer and the location. Each of the pair of side regions is positioned on opposite sides of the ridge and extends between the periphery, the ridge, and one of the two sides of the ramp whereby the chamfer engages a wall of the wellbore and extrudate is drawn along the pair of side regions. The method further involves engaging the chamfer of the drill bit with a wall of the wellbore. The method may also involve drawing extrudate from the wall of the wellbore down the pair of side regions, and/or flowing fluid down the ramp and toward the chamfer.

In another aspect, the disclosure relates to a method of making a drill bit that includes forming a bit body, forming a plurality of cutting elements for placement in the bit body, determining a balanced configuration for the cutting elements, and mounting the cutting elements in the bit body in the balanced configuration.

In some embodiments, the cutting elements includes a cutting face having a ramp and a pair of side regions thereon, the ramp having a curved edge along a periphery of the cutting face and two sides, each of the two sides extending from opposite ends of the curved edge and meeting at a convergence location. The cutting face further includes a non-planar feature, such as an elongate ridge, extending from the convergence location, such that each of the pair of side regions is positioned on an opposite side of the ridge and extends between the periphery, the ridge, and one of the two sides of the ramp. The cutting element may include a pair of facets at the leading edge of the cutting face, creating a cutting structure with a narrow leading edge and relatively sharp cutting tip. A bisecting line passes through the cutting element's center and bisects the leading edge.

In some embodiments, the cutting elements includes a substantially planar cutting face, and a pair of facets at the leading edge of the cutting face, creating a cutting structure with a narrow leading edge and relatively sharp cutting tip. A bisecting line passes through the cutting element's center and bisects the leading edge.

The methods disclosed herein further include positioning each of the cutting elements of the plurality in the bit body such that at least a portion of the element's cutting face extends beyond the bit body so as to be able to engage and remove formation material in an area of cut. For each cutting element to be balanced, the method includes determining a centroid of the area of cut, and fixing the cutting element in the bit body such that the ridge or the bisecting line extends through the centroid.

In some embodiments, the method comprises fixing at least a first cutting element of the plurality in the bit body such that the cutter's ridge or the bisecting line extends along a line that divides the area of cut into two regions having equal areas.

In some embodiments, the method comprises forming the cutting face of the plurality of cutting elements to include a shearing edge, fixing at least a first cutting element of the plurality in the bit body such that the cutter's ridge or the bisecting line extends along a line that divides the shearing edge into two segments of equal length.

In some embodiments, the method comprises determining the position of the peaks of formation material along the borehole wall that have been left uncut by previous revolutions of the bit and thus will be acted upon by a given cutting element of the plurality when it engages the material and removes its area of cut. The method may include fixing at least a first cutting element of the plurality in the bit body such that the cutter's ridge or bisecting line extends along a line that intersects the radially-innermost peak of uncut formation that lies in the area of cut.

In some embodiments, the method comprises determining a centroid using a technique selected from the group consisting of divided area technique, peak location technique, and shear line technique. In some embodiments, the method includes using a first technique to determine the centroid for a first of the cutting elements of the plurality, and using a second technique that is different than the first technique to determine the centroid for a second of the cutting elements of the plurality.

In another aspect, the disclosure relates to a drill bit having individually-balanced cutting elements. Such a bit may have at least a plurality of its cutting elements mounted in a balanced configuration. For the balanced cutting elements, the cutting element is mounted so a non-planar, elongate feature, such as a ridge, or so that a bisecting line of the element's cutting face, passes through the centroid of the cutting element's area of cut. In some embodiments, the location of the centroid is not the same for all the balanced cutting elements. In some embodiments, the cutting elements are positioned so that the non-planar, elongate feature extends along a line that divides the area of cut into two regions having equal areas. In some embodiments, the cutting elements of the plurality include a shearing edge that defines a boundary to the area of cut, and wherein, at least some of the cutting elements are positioned in the bit such that non-planar, elongate feature or bisecting line extends along a line that divides the shearing edge into two arcuate segments of equal length. In some embodiments, the cutting elements are positioned in the bit such that the non-planar, elongate feature or bisecting line extends along a line that intersects the radially-innermost peak of uncut formation that lies in the area of cut.

In another aspect, the disclosure relates to a drill bit with individually-balanced cutting elements where the bit includes a bit body having a plurality of cylindrical sockets configured to receive cutting elements, and a plurality of cutting elements configured to be mounted in the sockets. The cutting elements comprise a cylindrical base portion and a working surface attached to the base portion, the working surface comprising a balancing feature and a balancing line that passes through the balancing feature and passes through the center of the working face. The cutting elements of the plurality are mounted in a socket in the bit body so that the working surface of the cutting element is positioned to cut formation material in an area of cut that includes a centroid. The cutting elements are mounted in one of the sockets so that the balancing line of the cutting element passes through the centroid of the area of cut. The balancing feature may be an elongate non-planar feature, such as a ridge on the working surface, or may be a cutting tip on the cutting element. The cutting element may include a pair of facets and a cutting tip formed between the facets, wherein the balancing line in this embodiment bisects the cutting tip. In embodiments in which the balancing feature is an elongate non-planar element such as a ridge, the balancing line is a line aligned with the feature. The drill bit may include blades or ribs, wherein in one embodiment, all the cutting elements on a given rib are balanced. The cutting elements on a blade may have different balancing features, and they may have centroids that are not identical.

In another aspect, the disclosure relates to a method of making a drill bit that includes forming a bit body having cylindrical sockets configured to receive cutting elements;

and forming a plurality of cutting elements for mounting in the sockets, wherein each of the plurality of cutting elements comprises a cylindrical base portion and a working surface attached to the base portion, the working surface comprising a balancing feature and a balancing line that passes through the balancing feature and passes through the center of the working face. In the method, each of the cutting elements of the plurality is mounted in a socket in the bit body so that the working surface of the cutting element is configured to cut formation material in an area of cut. A centroid for the area of cut for each of the plurality of cutting elements is determined. Each of the cutting elements of the plurality is positioned in one of the sockets so that the balancing line of the cutting element passes through the centroid of the area of cut. The balancing line may be a bisecting line that bisects a cutting tip of the cutting element or may be a diametrically extending line that extends along the length of a ridge or other non-planar feature of a working surface.

BRIEF DESCRIPTION OF THE DRAWINGS

So that the above recited features and advantages can be understood in detail, a more particular description, briefly summarized above, may be had by reference to the embodiments thereof that are illustrated in the appended drawings. It is to be noted, however, that the examples illustrated are not to be considered limiting of its scope. The figures are not necessarily to scale and certain features and certain views of the figures may be shown exaggerated in scale or in schematic in the interest of clarity and conciseness.

FIGS. 3A-3E are perspective, top, bottom, left side, and rear views of one of the cutting elements having a central configuration.

DETAILED DESCRIPTION OF DISCLOSED EXEMPLARY EMBODIMENTS

The description that follows includes exemplary apparatuses, methods, techniques, and/or instruction sequences that embody techniques of the present subject matter. However, it is understood that the described embodiments may be practiced without these specific details.

This disclosure is directed to a cutting element (or insert) for a drill bit used to drill wellbores. The cutting element includes a face (or working surface) having at least two side regions with an elongated ridge therebetween, a ramp, and a chamfer. The ridge extends from the chamfer at a periphery of the face to a location along the face (e.g., a central part of the face) to draw extrudates down the pair of side regions. The ramp extends at an angle from the side regions to flow fluid toward the leading edge during drilling.

Figure 1:
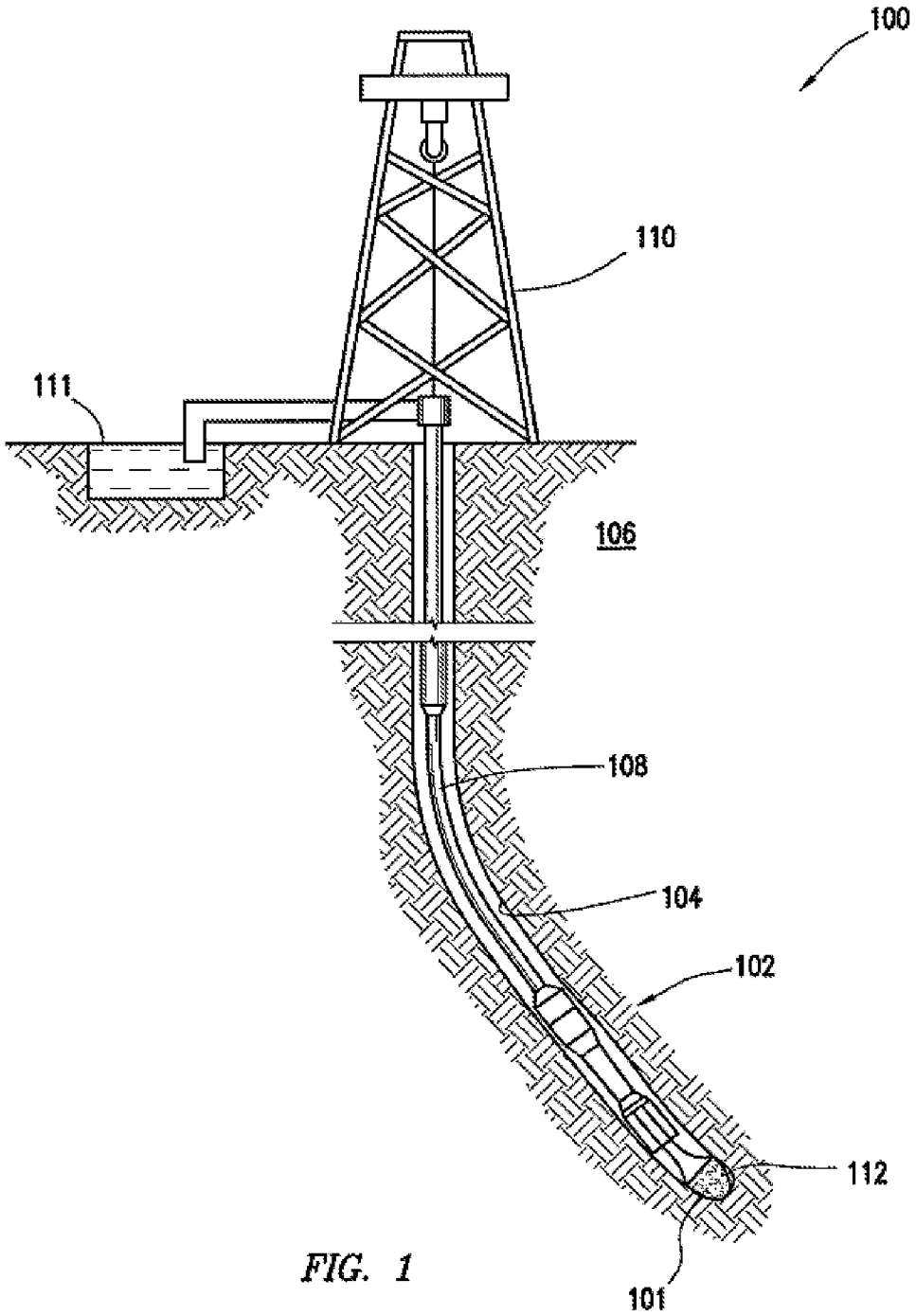
FIG. 1 is a schematic diagram of a wellsite including a rig with a downhole tool having a drill bit advanced into the earth to form a wellbore.

FIG. 1 depicts a wellsite 100 in which the subject matter of the present disclosure maybe used. As generally shown, cutting elements 101 and assemblies and processes employing the cutting elements may be deployed at a downhole end of a downhole tool 102 into a wellbore 104 formed in a subterranean formation 106 by any suitable means, such as by a rotary drill string 108 operated from a drilling rig 110 to rotate a drill bit 112. A mud pit 111 is provided at the wellsite 100 to pass drilling fluid through the downhole tool 102 and out the bit 112 to cool the drill bit 112 and carry away cuttings during drilling.

The "drill string" may be made up of tubulars secured together by any suitable means, such as mating threads, and the drill bit may be secured at or near an end of the tubulars as secured together. As used throughout this description, the term "wellbore" is synonymous with borehole and means the open hole or uncased portion of a subterranean well including the rock face which bounds the drilled hole. As used throughout this description, the terms "environ" and "environs" refers to one or more subterranean areas, zones, horizons and/or formations that may contain hydrocarbons.

The wellbore may extend from the surface of the earth, including a seabed or ocean platform, and may penetrate one or more environs of interest. The wellbore may have any suitable subterranean configuration, such as generally vertical, generally deviated, generally horizontal, or combinations thereof, as will be evident to a skilled artisan.

The quantity of energy referred to as "energy of extrusion" or "EE" means the portion of the total mechanical specific energy ("MSE") that is expended to extrude crushed rock particles across the faces of the cutting element(s) of the drill bit during drilling. As used throughout this description, the term "extrudate" refers to crushed rock particle conglomerates that are extruded across the face of the cutting element(s) during drilling. As also used throughout this description, the term "rock drill bit" refers to a fixed cutter, drag-type rock drill bit.

Figure 2A:
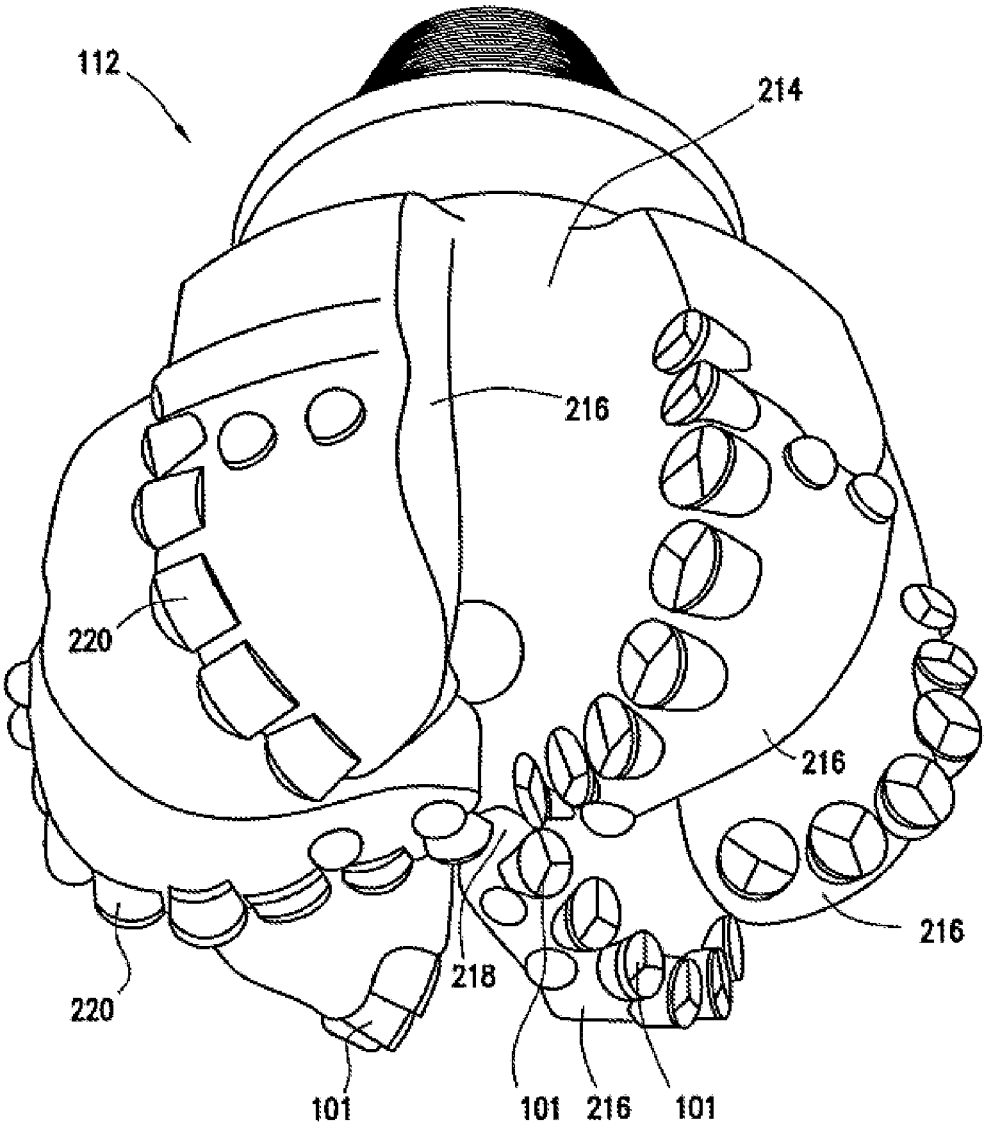
FIGS. 2A and 2B are perspective and end views, respectively, of a fixed cutter drill bit with cutting elements thereon.
Figure 2B:
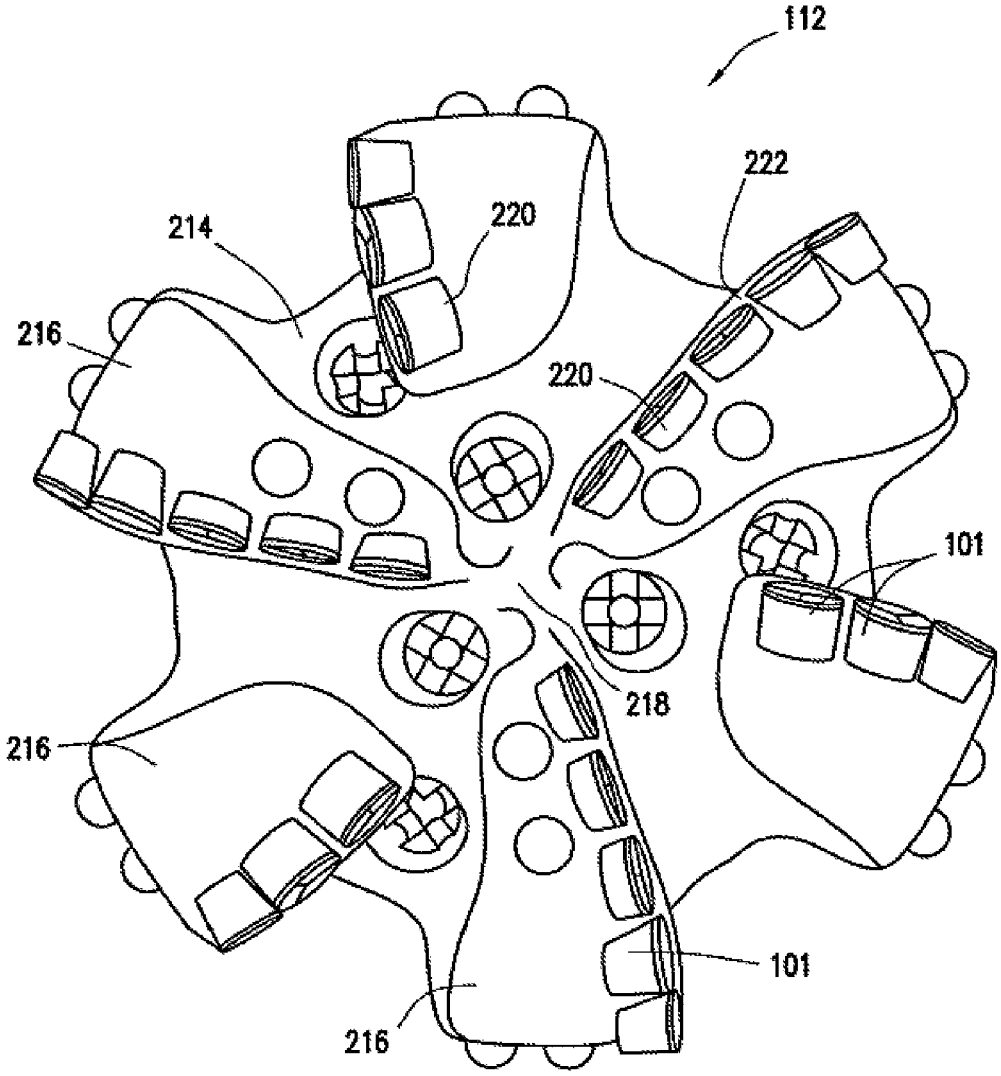

The cutting elements 101 described herein may be utilized in conjunction with any drill bit rotated by means of a drill string to form a wellbore in environs, such as a matrix, fixed cutter, rotary drag-type rock, or other drill bits usable with cutting elements. FIGS. 2A and 2B depict an example drill bit 112 that may be used with the cutting elements 101 described herein. As shown, the drill bit 112 is a drag-type rock drill bit having a bit body 214.

The bit body 214 may include one or more ribs (or blades) 216 that protrude from an outer periphery of the bit body 214. The ribs 216 extend along a portion of the bit body 214 and terminate on or near a nose 218 thereof. The nose 218 is at a central location about an end of the bit body 214 where the ribs 216 converge. The bit body 214 may also be provided with one or more passages 222 between the ribs 216 for transporting drilling fluid to the surface of the bit body 214 for cooling and/or cleaning exposed portions of the cutting elements 101 during drilling operations.

One or more cutting elements 101 are mounted in at least one of the ribs 216 by positioning a portion of each cutting element 101 within a socket 220 and securing it therein by any suitable means as will be evident to a skilled artisan, for example by means of pressure compaction or baking at high temperature into the matrix of the bit body 214. The cutting elements 101 may be positioned in the sockets 220 at a desired orientation.

The cutting elements 101 may be randomly positioned about the bit body 214. The orientation of the cutting elements 101 may optionally be selected so as to ensure that the leading edge of each cutting element 101 may achieve its intended depth of cut, or at least be in contact with the rock during drilling. For example, the cutting elements 101 may be oriented in the sockets 220 in the same orientation, such as with a specific portion, such as a leading (or cutting) edge, of each cutting element pointing in the same direction. In another example, the cutting elements 101 may be oriented in a pattern such that a specific point, such as the leading edge of each of the cutting elements 101, points towards the nose 218 and the relative angle of each leading edge is shifted away from the nose 218 the further from the nose 218 the cutting element 101 is positioned. In yet another example, the orientation of the cutting elements 101 positioned about the nose 218 of the drill bit 112 may be offset at an angle, such as about 90 degrees, from an orientation of those cutting elements 101 positioned near a periphery of the bit body 214.

Cutting Element with Chamfered Ridge

FIGS. 3A-3E depict the cutting element 101 in greater detail. Additional views of the cutting element 101 are provided in FIGS. 4A-4G. A face (or working surface) 328 at an exposed end of each cutting element 101 as mounted in bit body 214 includes geometric partitions of surface area along the face 328, each having a functional role in abrading/shearing, excavating, and removing rock from beneath the drill bit 112 during rotary drilling operations.

As illustrated, each cutting element 101 includes a diamond (e.g., polycrystalline diamond ("PCD")) layer 324 bonded to a less hard substrate 326. While a single diamond layer 324 and substrate 326 are depicted, one or more layers of one or more materials may be provided as the layer, substrate and/or other portions of the cutting element 101.

The cutting elements described herein may be formed of various materials. For example, the substrate 326 may be made of tungsten carbide and the diamond layer may be formed of various materials including diamond. Other layers and/or portions of may optionally be provided. Part and/or all of the diamond layer (e.g., chamfer 336) may be leached, finished, polished, and/or otherwise treated to enhance operation. Examples of materials and/or treatments, such as leaching are described in Patent/Application Nos. U.S. 61/694,652, WO 2014/036283, W020 12/056196, W020 12/0 12774, US20 12/00 18223, US20 11/0031 028, US2011/0212303, US2012/0152622, and/or US2010/0200305, the entire contents of which are hereby incorporated by reference herein.

When inserted into a socket 220 of the bit body 214 as shown in FIGS. 2A-2B, an element body of the cutting element 101 is positioned with a diamond layer 324 extending outside of the socket 220 and has the face 328 at an end thereof for engagement with the wellbore. The cutting element 101 may have any suitable general configuration as will be evident to a skilled artisan, for example a generally cylindrical configuration as shown, and with a generally constant diameter D (e.g., about 16 mm) along about the entire length L (e.g., of about 13 mm) thereof.

The cutting element 101 may include a pair of side regions 330*a,b*, an elongated ridge 332, a ramp 334, and a chamfer 336 about the face 328. The side regions (or slanted surfaces) 330*a,b* extend from a periphery 338 of the cutting element 101 a distance therein. The regions 330*a,b* are generally pie shaped regions defined by an obtuse angle extending from a center C of the face 328 and a portion of the periphery 338. The side regions 330*a,b* may have any angle, such as a surface angle A λ of about 135 degrees, and a slant angle φ of about 10 degrees (or from about 2 degrees to about 20 degrees). The regions 330*a,b* may be symmetrical relative to each other on either side of the ridge 332.

The ridge 332 is positioned along a side of each of the side regions 330*a,b* to separate the side regions 330*a,b*. The ridge 332 may be generally perpendicular to a leading edge 340 of the cutting element, and may be centrally oriented along the face 328. The ridge 332 extends from the leading edge 340, located at the periphery of the face 328, to about the center C of the face 328. The ridge 332 may extend along a portion of the diameter of the face 328, for example, from about 113 to ⅔ of a diameter D of the face 328.

The ridge 332 defines a protrusion extending from the chamfer 336 at the periphery 338 and to the center C of the face 328 between the regions 330*a,b*. The ridge 332 may have a length LR equal to a radius R of the face 328 and defines a side of the adjacent regions 330*a,b*. The radius R may have a length of about 8 mm. The ridge 332 may have a length defined for bisecting and physically splitting apart extruding rock particle conglomerates or extrudates and directing the smaller, split extrudate portions into the regions 330*a,b*.

The ridge 332 may have a uniform width along the entire length thereof and may have uniform height along the entire length thereof, or may possess a height that varies, such as by increasing from the end thereof proximate to the leading edge 340 to an opposite end thereof at a location at or near the ramp 334. The ridge 332 may have a width W of, for example, about 0.50 mm.

The chamfer 336 extends along a portion of the periphery 338 and defines the leading (or cutting) edge 340. The chamfer 336 as shown extends along about 10 degrees of the periphery 338 and has a height H of about 0.3 mm. The chamfer 336 may extend from about 2 degrees to about 360 degrees of the periphery 338. The leading edge 340 may be a portion of an edge of the cutting element 101 illustrated as being about the chamfer 336. The leading edge 340 may be dimensioned to achieve a generally predetermined depth-of-cut into rock.

The chamfer 336 may extend from the ridge 332 at a chamfer angle e of about 45 degrees (or from about 15 degrees to about 75 degrees). The chamfer 336 may be formed along a peripheral end of the ridge 332 at the leading edge 340. By extending the ridge 332 to the periphery 338 of the cutting element 101, at the leading edge 340, the regions 330*a,b* and the ridge 332 may provide a leading edge 340 defined for splitting of the rock particle conglomerates or extrudates.

The ramp 334 defines a third pie shaped region extending from a central end of the ridge 332 and between adjacent regions 330*a,b*. The ramp 334 provides a surface to define rigid back support and stability to the regions 330*a,b*. The ramp 334 may extend from the ridge 332 and along the regions 330*a,b* at a ramp angle α of about 90 degrees between the regions 330*a,b*. The ramp angle α may also extend at any angle, such as from about 60 degrees to about 120 degrees. The ramp 334 may also have an incline angle β of, for example, of about 10 degrees.

In the example of FIG. 3A, the ramp 334 has a curved edge 335 along a periphery of the face and two sides 337*a,b*. Each of the two sides 337*a,b* extend from opposite ends of the curved edge 335 and converging at the location (e.g., center) C along the face 328. The ridge 332 is between the chamfer 336 and the location C. Each of the pair of side regions 330*a,b* is positioned on opposite sides of the ridge 332 and extends between the periphery 338, the ridge 332, and one of the two sides 337*a,b* of the ramp 334.

As shown by these views, the cutting element 101 is in a central configuration with the ridge 332 extending from a central area of the face 328 of the cutting element 101. As shown, the ridge 332 extends from the center C of the face 328 to divide the side regions 330*a,b* into equal portions. In this configuration, the ramp 334 and the side regions 330*a,b* are of a similar dimension. The ramp 334 and the side regions 330*a,b* may have any shape, such as planar (as shown), concave, and/or a combination of curved and/or planar surfaces. The ramp 334 may be shaped to flow drilling fluid toward the ridge 332 and the leading edge 340, and the chamfer 336 may be positioned to engage a wall of the well bore such that extrudate is drawn along the pair of side regions during operation.

Figure 3E:
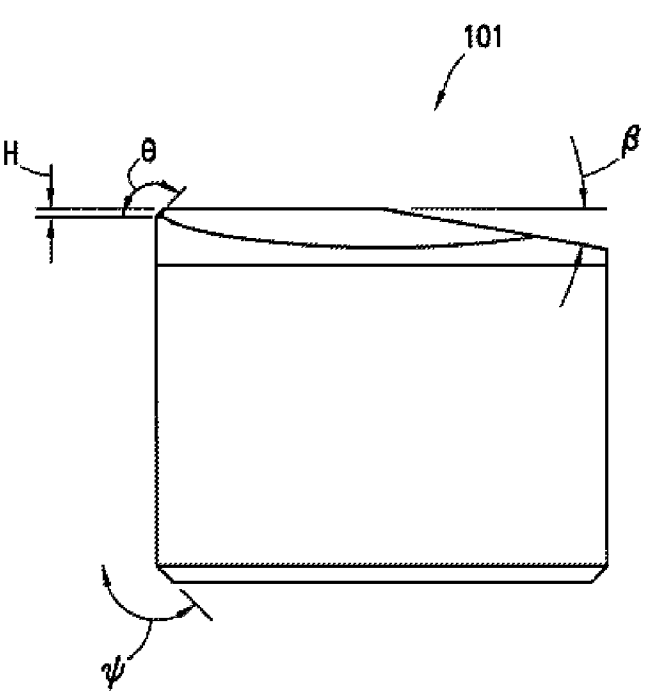
Figure 3D:
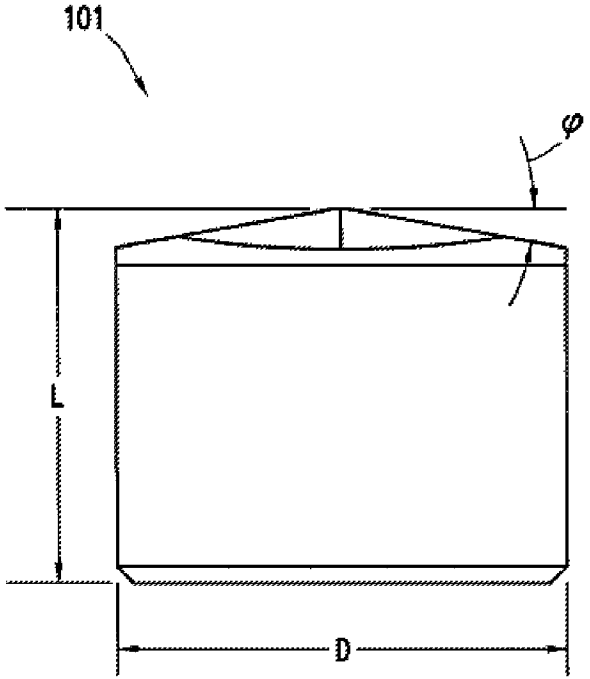
Figure 4B:
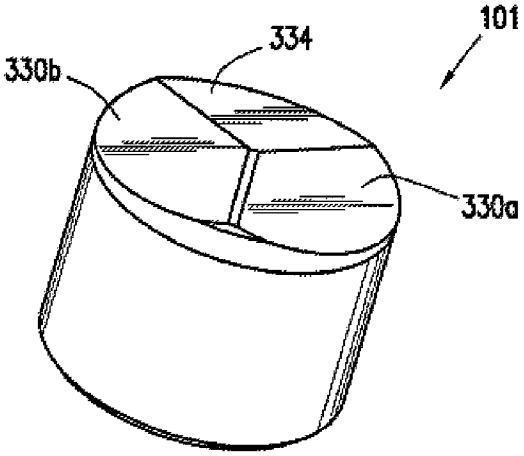
FIGS. 4A-4G are additional perspective and side views of the cutting element of FIG. 3A.
Figure 4A:
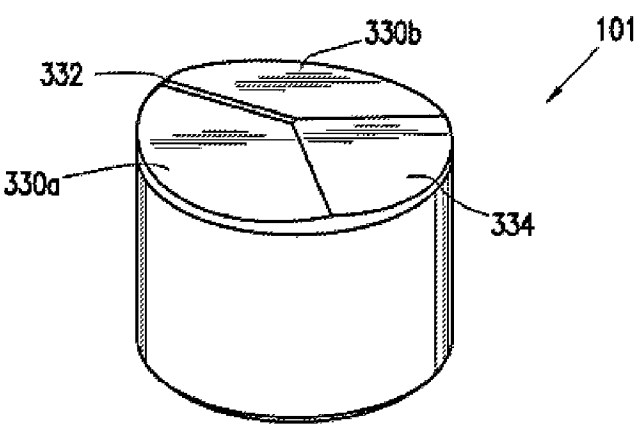
Figure 4C:
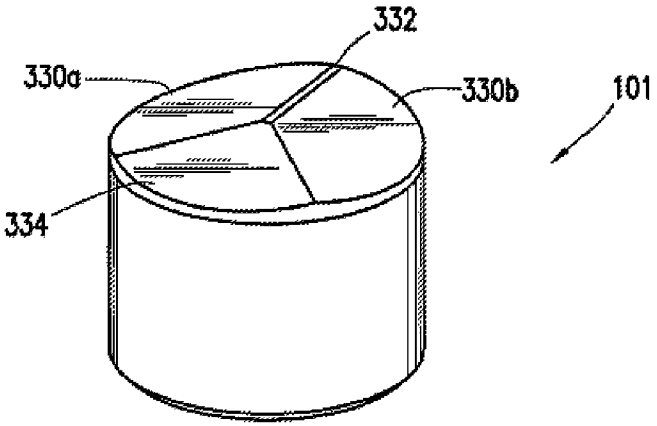
Figure 4E:
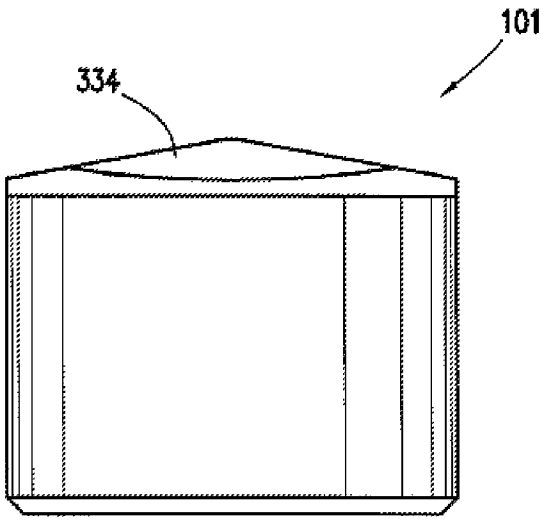
Figure 4D:
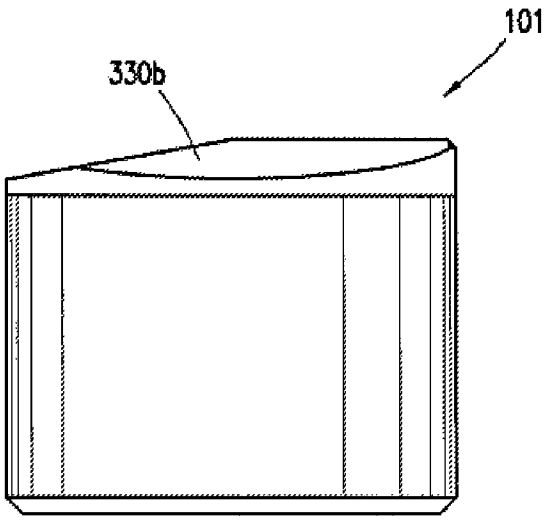
Figure 4G:
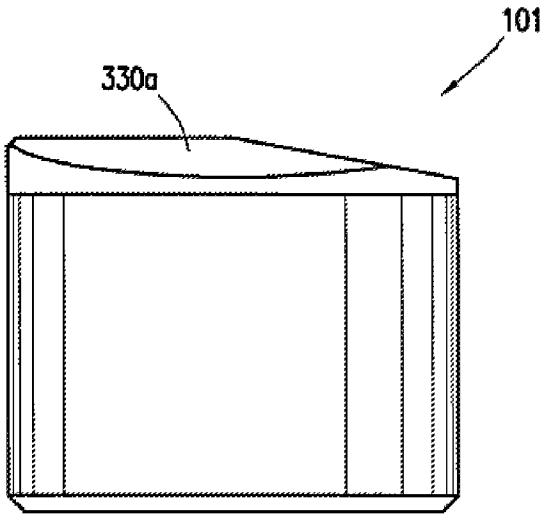
Figure 4F:
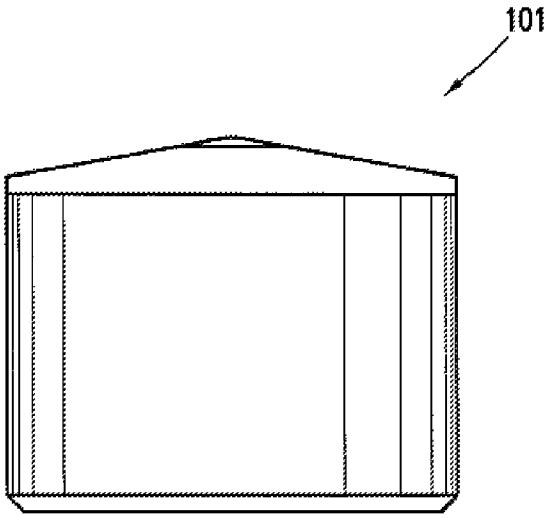
Figure 5B:
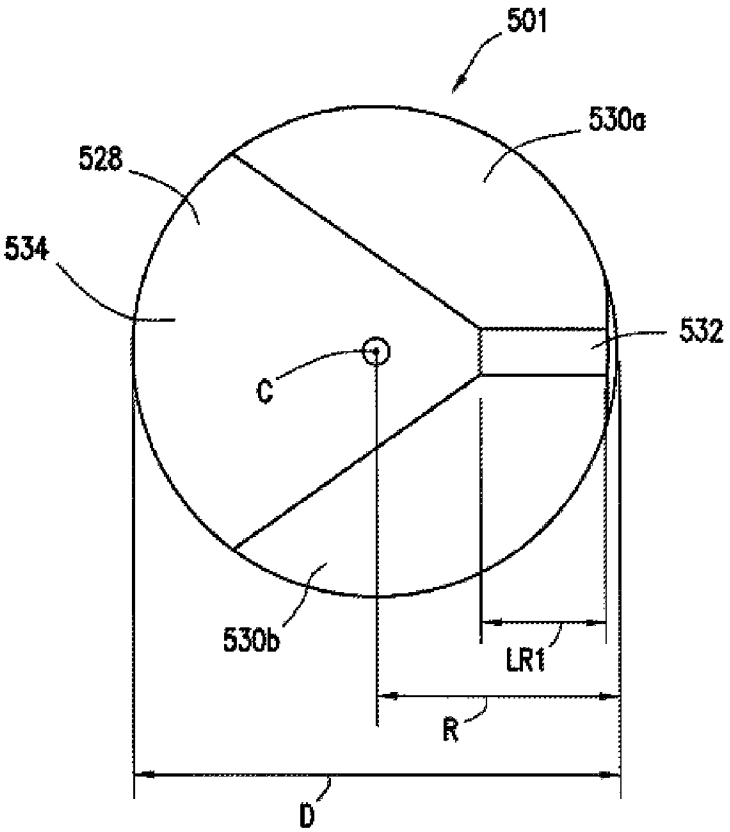
FIGS. 5A-5E are perspective, top, front, rear, and side views, respectively, of a cutting element having an offset configuration.
Figure 5A:
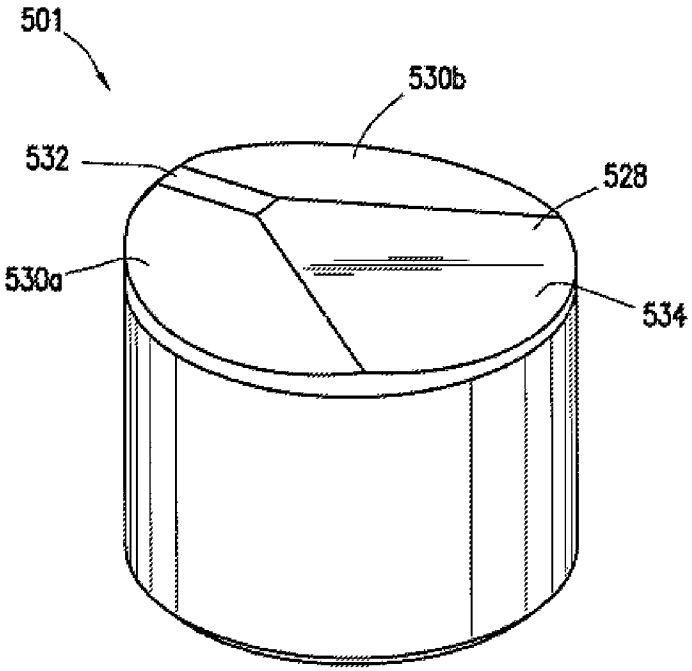
Figure 5D:
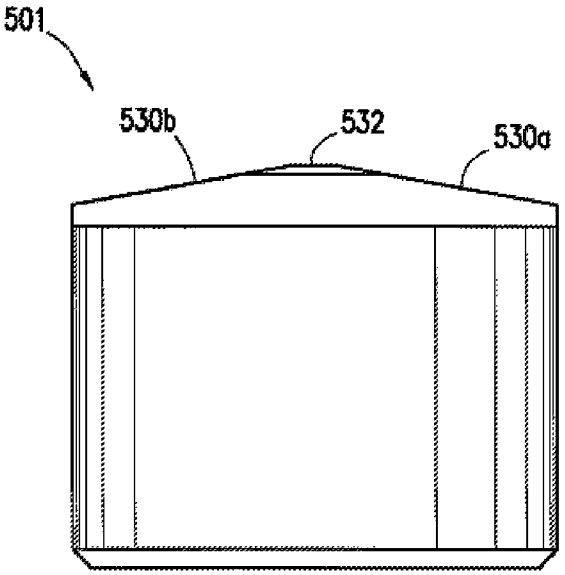
Figure 5C:
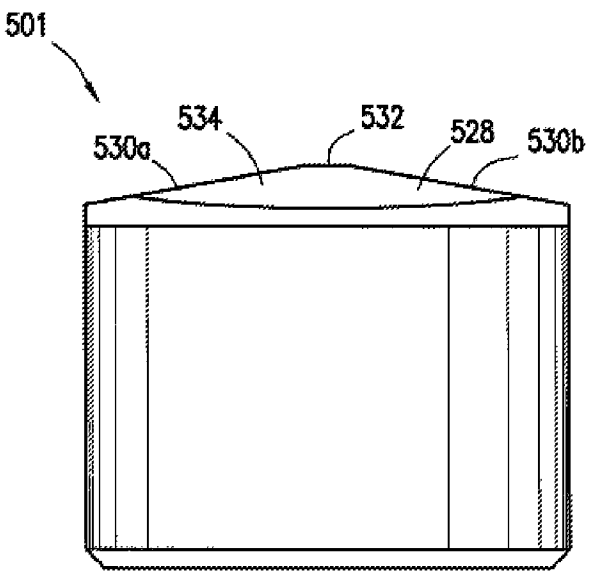

The cutting element 101 may also be provided with other features and/or geometries. For example, as shown in FIG. 3C, the cutting element 101 has a bottom surface (or end) 325 with a bevel 327 along the periphery 338. The bevel 327 may have a bevel angle ψ (in FIG. 3E) of about 45 degrees, or at an angle from about 35 degrees to about 50 degrees.

In operation, drilling fluid passing through the downhole tool 102 and out the drill bit 112 (FIG. 1) may flow through the passages 222 and over the cutting element(s) (e.g., 101) in the ribs 216 (FIG. 2). The leading edge 340 of the cutting elements(s) may engage and dislodge rock along the wellbore to form extrudates. The regions (e.g., 330*a,b*) may direct opposing forces to extrudates at positive non-zero angles to the two-dimensional plane of the leading edge 340. These forces may urge the extrudates into the drilling fluid until such point in time when the surface area of each extrudate exceeds a critical value and the extrudate is broken off into the flow regime of the drilling fluid. The ramp (e.g., 334) may be used to flow the drilling fluid toward the face (or working surface) (e.g., 328) to reduce interfacial friction between the working surface and rock extrudate, and carry extrudate away as it is dislodged about the leading edge 340.

The configuration of the cutting elements may split extrudate into smaller portions without interrupting extrudate formation in such a way that limits the volume and mass (less energy of formation) of the extrudate. In this manner, reduced frictional forces between the cutter working surface and rock extrudate may result in extrudate removal with less EE. Accordingly, less input energy may be required to drill at a given rate of penetration, thereby reducing MSE while drilling.

FIGS. 5A-7E depict views of additional versions of a cutting element 501, 601, 701. FIGS. 5A-5E show the cutting element 501 in an offset configuration. FIGS. 6A-6E show the cutting element 601 having an offset, inward tapered configuration. FIGS. 7A-7E show the cutting element 701 having an offset, outward tapered configuration. The cutting elements 501, 601, 701 are similar to the cutting element 101, except that the cutting elements 501, 601, 701 may have a ridge 532, 632, 732 positioned a distance from a center of the face 528, 628, 728, and/or may have various shapes.

In the example of FIGS. 5A-5E, the cutting element 501 has the face 528 with side portions 530*a,b*, the ridge 532, and a ramp 534. The cutting element 501 is similar to the cutting element 101, except that the ridge 532 extends from a periphery 338 to a location a distance from the center C. As shown by this example, the ridge 532 may have a length LR1 that is less than 112 of the diameter D (and less than the radius R) of the face 528 (e.g., about 113 of the diameter D).

Figure 6A:
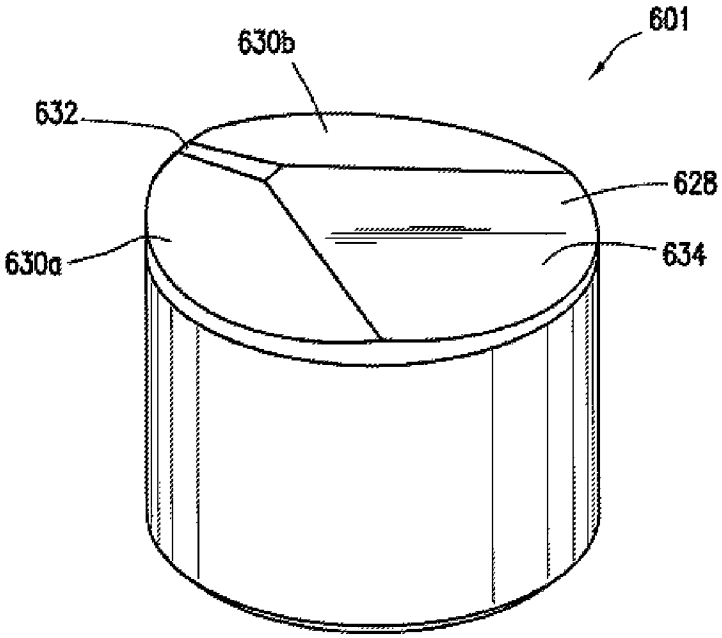
FIGS. 6A-6B are perspective and top views, respectively, of a cutting element having an offset, inward tapered configuration.
Figure 5E:
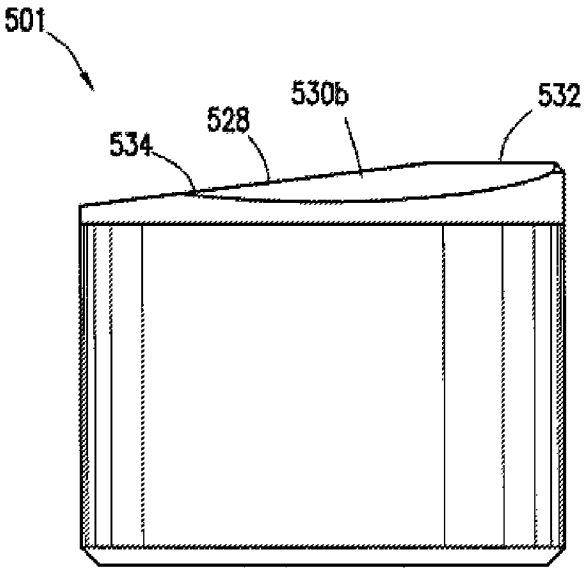
Figure 7A:
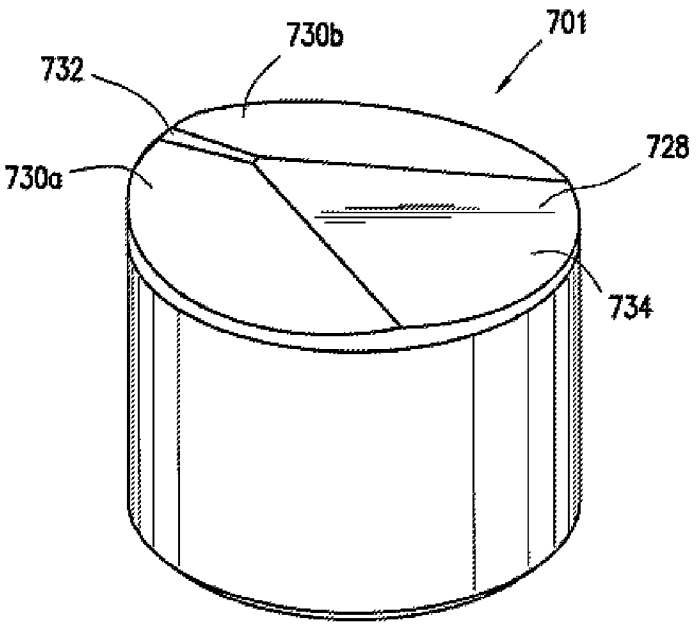
FIGS. 7A-7B are perspective and top views, respectively, of a cutting element having an offset, outward tapered configuration.
Figure 6B:
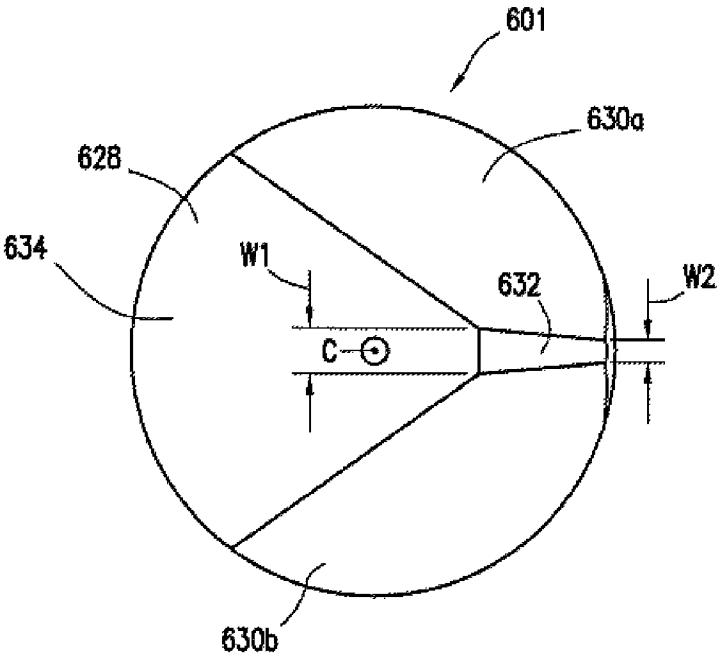

In the example of FIGS. 6A-6B, the cutting element 601 has the face 628 with side portions 630*a,b*, the ridge 632, a ramp 634. The cutting element 601 is similar to the cutting element 501, except that a width of the ridge 632 has an inward taper. As shown by this example, the ridge 632 may have a width W2 at the periphery and a wider width W1 at an opposite end.

In the example of FIGS. 7 A-7B, the cutting element 701 has the face 728 with side portions 730*a,b*, the ridge 732, a ramp 734. The cutting element 701 is similar to the cutting element 601, except that a width of the ridge 732 has an outward taper. As shown by this example, the ridge 732 may have a width length W3 at the periphery and a narrower width W4 at an opposite end.

Figure 8:
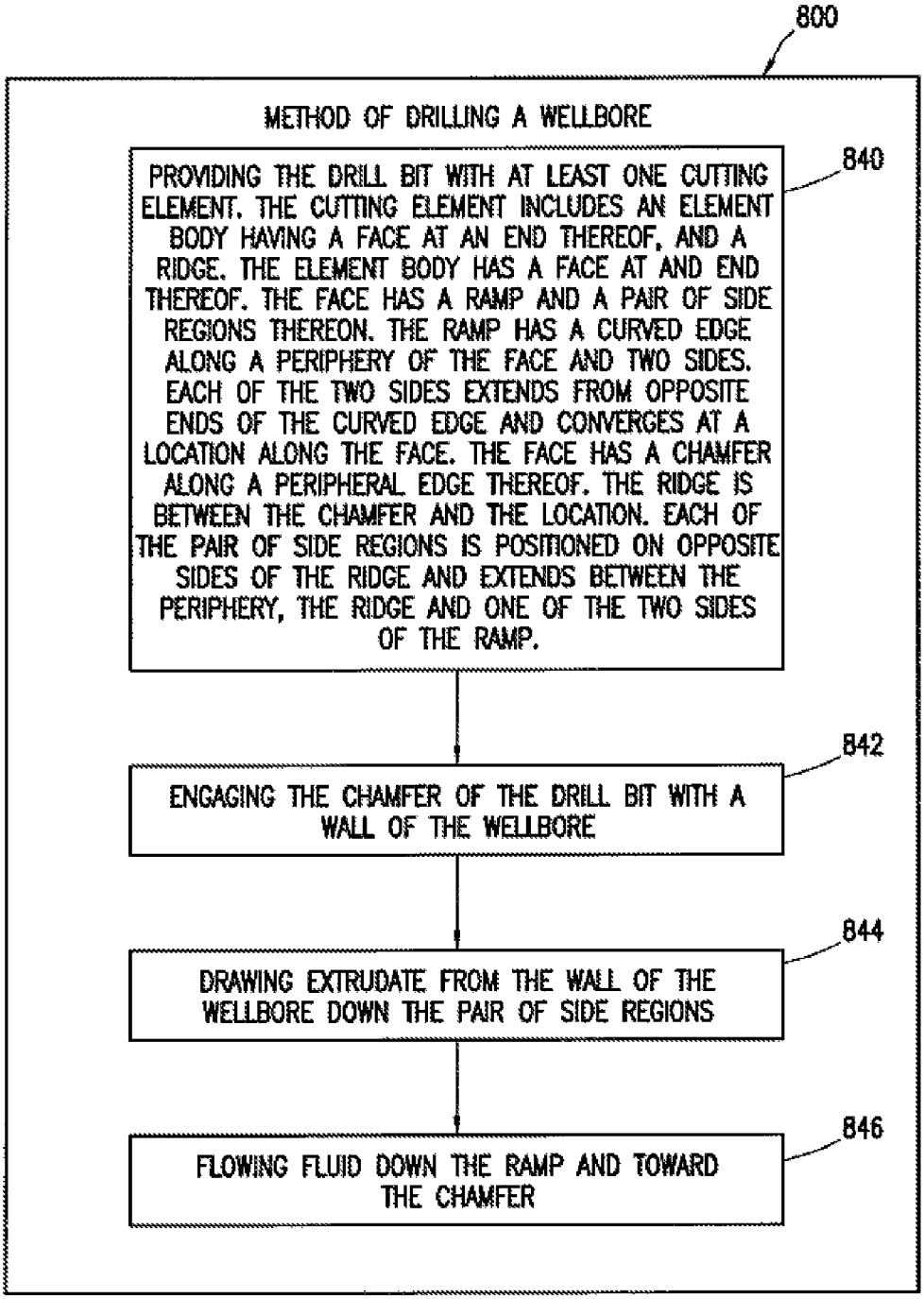
FIG. 8 is a flow chart depicting a method of drilling a wellbore.

FIG. 8 is a flow chart depicting a method 800 of drilling a wellbore. The method involves 840 providing the drill bit with at least one cutting element. The cutting element includes an element body having a face at an end thereof, and a ridge. The face has a ramp and a pair of side regions thereon. The ramp has a curved edge along a periphery of the face and two sides. Each of the two sides extends from opposite ends of the curved edge and converges at a location along the face. The face has a chamfer along a peripheral edge thereof. The ridge is between the chamfer and the location. Each of the pair of side regions is positioned on opposite sides of the ridge and extends between the periphery, the ridge, and one of the two sides of the ramp.

The method may also involve 842 engaging the chamfer of the drill bit with a wall of the wellbore, 844 drawing extrudate from the wall of the wellbore down the pair of side regions, and/or 846 flowing fluid down the ramp and toward the chamfer. The method may also involve advancing a drill bit into a subterranean formation to form a wellbore. The method may be performed in any order and repeated as needed.

Ridged Cutting Elements that May be Balanced or Unbalanced

This disclosure also relates to a drill bit with balanced cutting elements. The cutting elements are positioned about a drill bit for cuttingly engaging a wall of a wellbore. The cutting elements have a working surface with a non-planar feature (e.g., a ridge) to engage the wall and cut away portions thereof to form the wellbore. The cutting elements and/or non-planar features may be positioned in a random configuration, or placed in a balanced configuration about the drill bit. In the balanced configuration, the non-planar feature of each of the cutting elements may be individually positioned about the drill bit based on the location of a centroid of an area of cut of the cutting elements. In this placement, the cutting elements are said to be individually-balanced, a balancing achieved via their rotational position within a socket in the bit body. This is distinct from cutter elements being positioned higher or lower in the bit's cutting profile, and differs from being mounted with differing rake angles.

The 'area of cut' as used herein refers to the portion of the working surface of the cutting element that engages the wall of the wellbore. The area of cut is a cross section of the cut for each cutter projected at a reference plane that intersects the bit rotation axis and cutter tip.

'Centroid' as used herein refers to a virtual point defined about the working surface of the cutting element. This centroid may be defined as, for example, a geometric center of the working surface, a mass center of a portion of the cutting element, a center of forces acting on the cutting element, and/or another point that defines a functional position along the working surface of the cutting element and/or drill bit. The cutting element and/or non-planar features may be positioned about the drill bit based on the centroid. Such placement may be defined with the intended purpose of, for example, enhancing cutting action, increasing cutting efficiency, and/or force balancing the cutting elements and/or the drill bit during operation.

Figure 9:
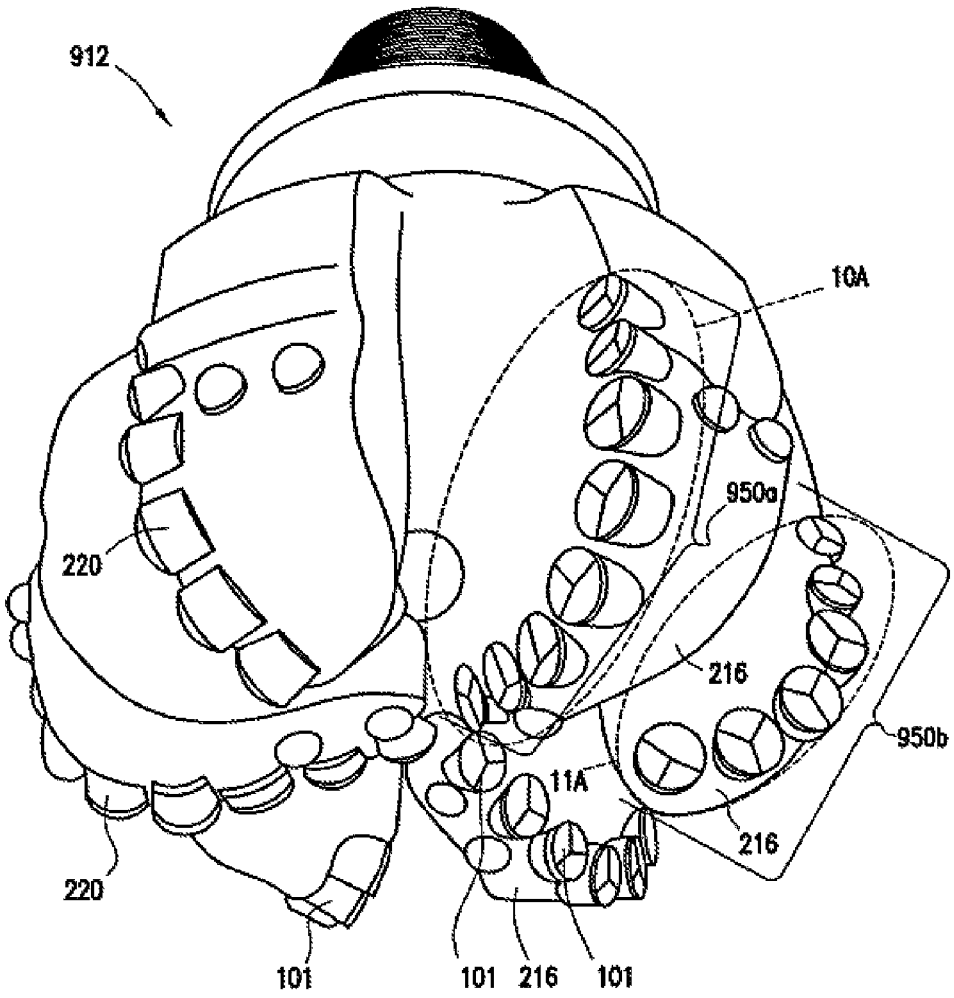
FIG. 9 is a perspective view of a fixed cutter drill bit with balanced cutting elements.

FIG. 9 is a perspective view of a drill bit 912 with balanced cutting elements 101 thereon. The drill bit 912 may be similar to the drill bit 112 as previously described, except with the cutting elements 101 in a balanced position about the drill bit 912. The balanced cutting elements 101 of FIG. 9 are depicted as the same cutting elements as described with respect to 1-7B. However, it will be appreciated that any cutting elements with a non-planar feature may be used.

The cutting elements 101 are positioned in the sockets 220 along the ribs 216 of the drill bit 912. Each rib 216 has a curved outer surface defining a cutting (or surface) profile along an outer periphery of the drill bit 912. The sockets 220 are positioned along the profile with the cutting elements 101 therein. The cutting elements 101 are positioned along the profile such that an outer edge (or shear line) of each of the cutting elements 101 is positioned to engage the wall of the wellbore.

As shown in FIG. 9, a group 950*a* of cutting elements 101 is in a random configuration, and group 950*b* of cutting elements 101 is in a balanced configuration along the ribs 216 as is described further herein. While FIG. 9 shows a matrix drill bit with cutting elements in a specific configuration, it will be appreciated that one or more of various types of drill bits and/or cutting elements may be provided in a variety of configurations.

Figure 10B:
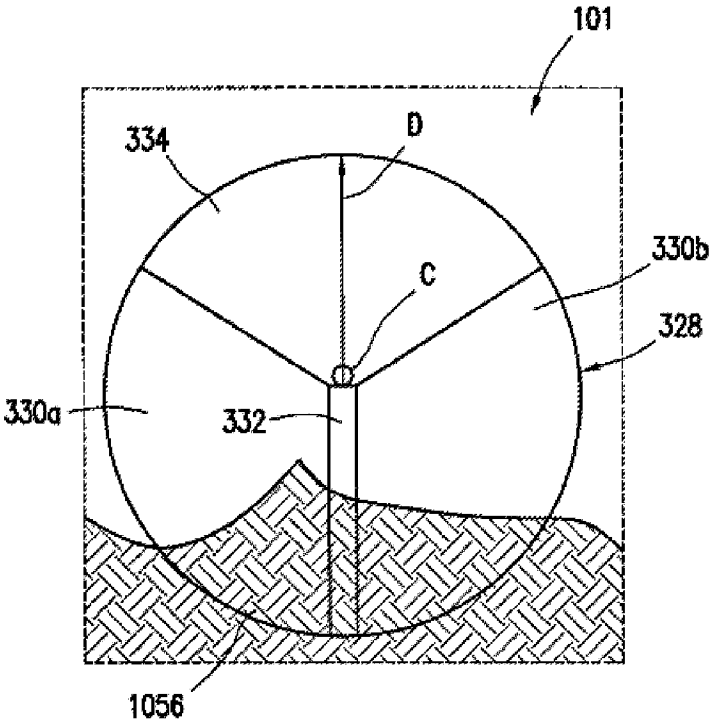
FIG. 10B is a detailed view of portion 10B of FIG. 10A.
Figure 10A:
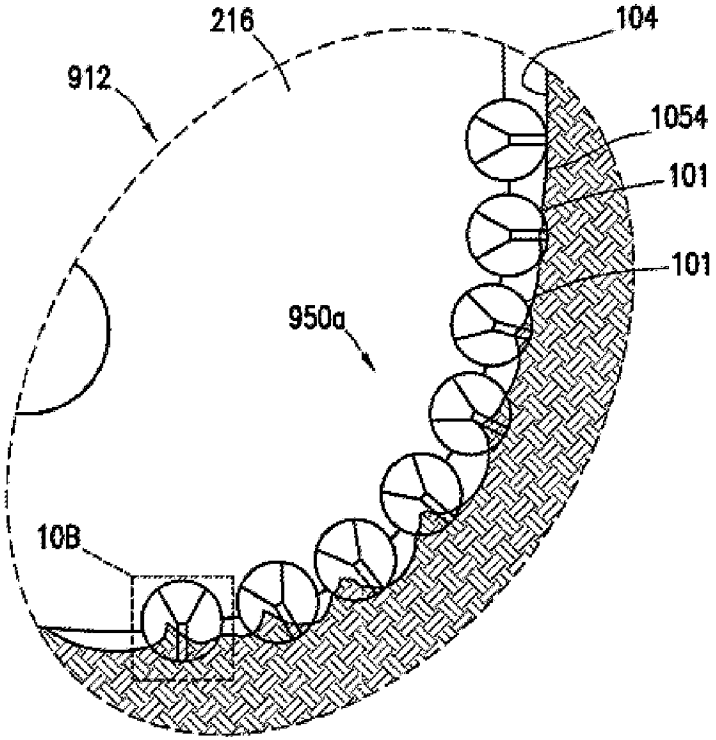
FIG. 10A is a detailed view of a portion 10A of the drill bit of FIG. 9 having cutting elements in a random configuration.
Figure 11B:
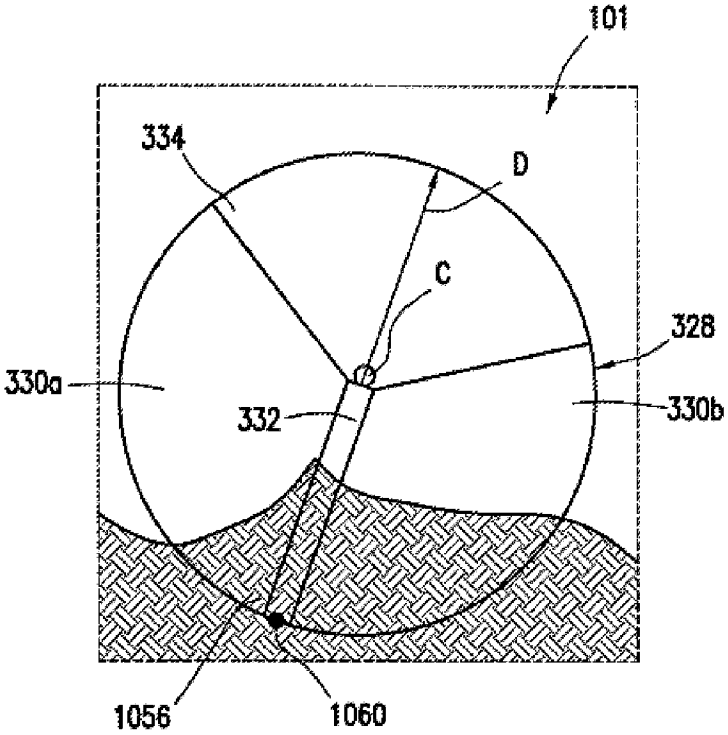
FIG. 11B is a detailed view of portion 11B of FIG. 10A.
Figure 11A:
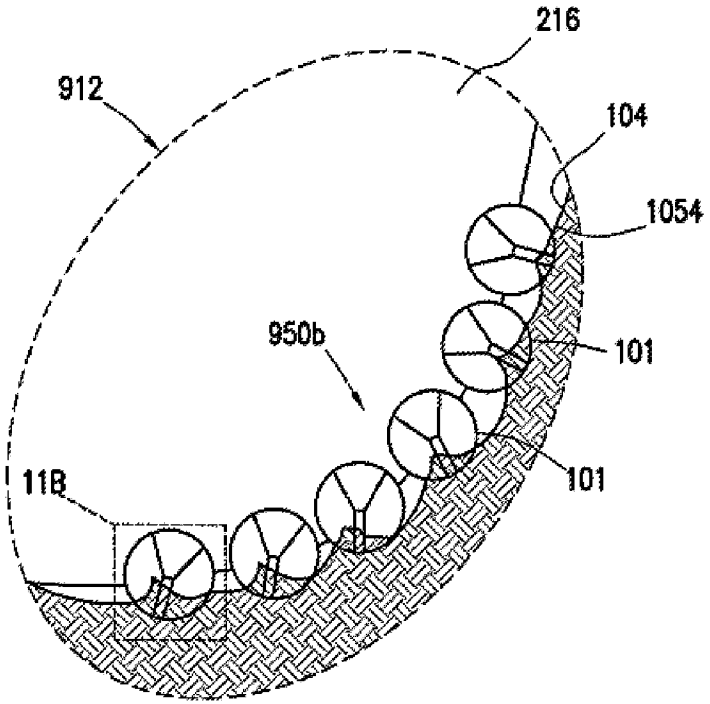
FIG. 11A is a detailed view of a portion 11A of the drill bit of FIG. 9 having cutting elements in a balanced configuration.

FIGS. 10A and 11A show portions 10A and 11A, respectively, of the drill bit 912 of FIG. 9 positioned against the wall 1054 of the well bore 104. FIG. 10A is a detailed view of the group 950*a* cutting elements 101 in the random configuration along rib 216. FIG. 10B is a detailed view of a portion 10B of the rib 216 of FIG. 10A depicting one of the cutting elements 101. FIG. 11A is a detailed view of the group 950*b* of the cutting elements 101 in the balanced configuration along rib 216. FIG. 11B is a detailed view of a portion 1B of the rib 216 of FIG. 11A depicting one of the cutting elements 101.

In the examples shown in these figures, each of the cutting elements 101 have the same working surface 328 with non-planar features including the side regions 330*a,b*, the elongated ridge 332, and the ramp 334 thereon as in FIG. 3A. A diameter (D) of the cutting elements 101 passes through a geometric center (C) of the working surface 328 of the cutting elements 101.

Each cutting element 101 also has an area of cut 1056 depicting the portion of each of the cutting element 101 that engages the wall 1054 of the wellbore 104 during drilling. As shown, the area of cut 1056 is different for each cutting element 101 according to the position of the cutting element along the rib 216. The area of cut for each of the cutting elements may be determined, for example, by empirical methods or by calculation (e.g., based on size, shape, position along the rib profile, orientation to the wall of the wellbore, etc.)

In FIG. 10A-B, each of the cutting elements 101 is oriented along rib 216 such that the same non-planar feature (e.g., ridge 332) is positioned to engage the wellbore. The ridge 332 is positioned along diameter D and center C, and about the working surface 328 irrespective of the location of the area of cut 1056. In this 'random' configuration, the ridge 332 of each cutting element 101 mayor may not be positioned relative to the area of cut 1056 of the cutting elements 101. While random with respect to its placement about the area of cut, the cutting elements may be aligned, for example with ridge 332 of each cutting element positioned perpendicular to the portion of the profile on which such cutting element is located.

For comparison, FIGS. 11A and 11B are depicted as being the same as FIGS. 10A and 10B, except that the cutting elements 101 are in the 'balanced' configuration based on the area of cut 1056. In this version, the ridges 332 are positioned about the rib 216 for engagement with the wall of the wellbore and balanced with respect to the area of cut 1056. A centroid 1060 of the area of cut 1056 is defined for each cutting element 101 based on its position about the rib 216. The ridge 332 is shifted from its position in FIG. 10 to its balanced positioned along the working surface 328 of each of the cutting elements such that it extends through the centroid 1060 defined for each cutting element.

Because each of the cutting elements 101 has a different area of cut 1056 based on its location along the bit profile, and therefore a different location for its centroid 1060, the ridge 332 may be located in a different position along the working surface 328 of each of the cutting elements 101 depending on its area of cut 1056. The ridge 332 (or other non-planar feature) is relocated along the working surface 328 to align with the centroid 1060.

Figure 12B:
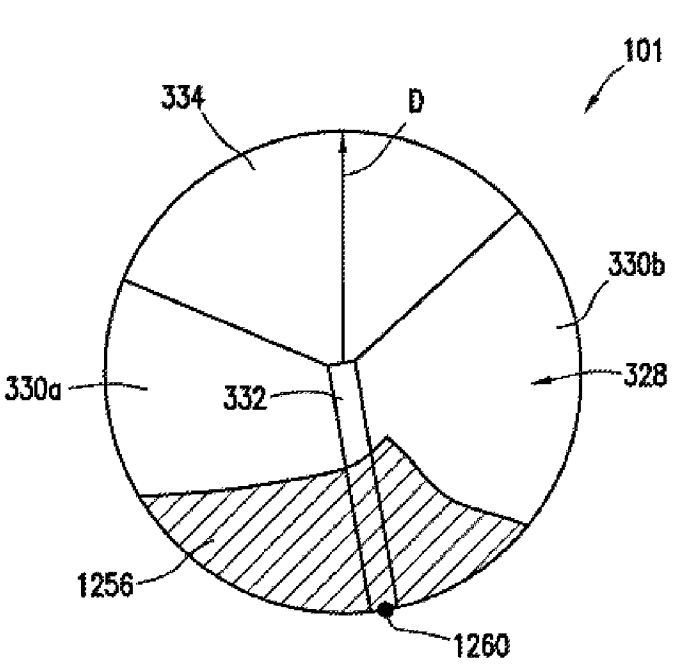
FIGS. 12A-12B are schematic diagrams of a working surface of the cutting element having a ridge in the random and the balanced configurations, respectively.
Figure 12A:
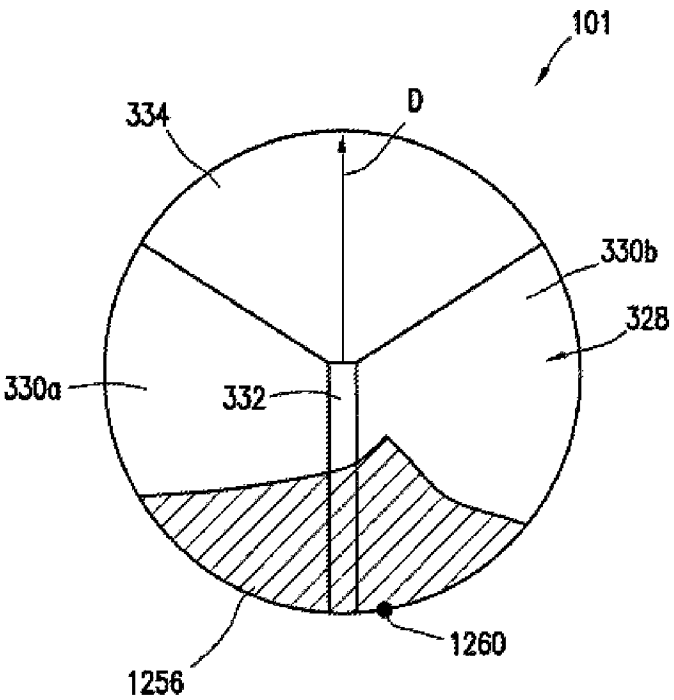

FIGS. 12A and 12B show balancing of a cutting element 101. FIG. 12A shows the cutting element 101 with the ridge 332 in a random configuration. FIG. 12B shows the cutting element after it is shifted from the random position of FIG. 12A to a balanced configuration about the working surface 328. As shown in FIG. 12A, the ridge 332 of the cutting element 101 is positioned with the ridge 332 a distance from the centroid 1260, but may be anywhere relative to the centroid 1260 in the random configuration. As shown in FIG. 12B, the ridge 332 is shifted to align with the centroid 1260 in the balanced configuration.

The centroid 1260 is a virtual point defined about the area of cut 1256. The centroid 1260 may be used to balance the cutting element by positioning the ridge 332 (or other nonplanar features) on the working surface 328 of the cutting elements 101 to provide force distributions along the working surface 328 of each cutting element 101 as the drill bit 912 is rotated during drilling. The centroid may define a dividing (or balancing) line along the working surface 328 of the cutting elements 101 on the drill bit 912, and/or a central position along the cutting element 101 for placement of the ridge 332 (or other non-planar feature) in order to balance forces acting on the cutting elements 101 and/or to increase cutting efficiency. This alignment may be used to balance of forces about portions of the cutting elements (e.g., on opposite sides of the cutting element 101 to the direction of cut).

For example, for cutting elements 101 that have a non-planar feature, such as the ridge 332, the area of cut 1256 may be asymmetrical (i.e., larger (or dominant) on one side of the cutting element 101) which may cause side forces to apply a side rake angle to the cutting elements. The centroid 1260 may be located and the ridge 332 relocated to account for this asymmetry. This balanced configuration may be used to individually and/or independently balance each of the cutting elements 101 based on their individual areas of cut to increase operational efficiency.

While FIGS. 10-12B show cutting elements 101 in a specific configuration, any cutting element with various non-planar features, such as ridges, ramps, depressions, chamfers, and/or other nonplanar features may be provided. Placement may be defined for one or more of these features as in the example of placement to the ridge 332 as shown in FIGS. 12A-12B, and/or by defining a centroid of the cutting element based on a structure of the cutting element (e.g., mass balance, geometry, weight, etc.)

Figure 13A:
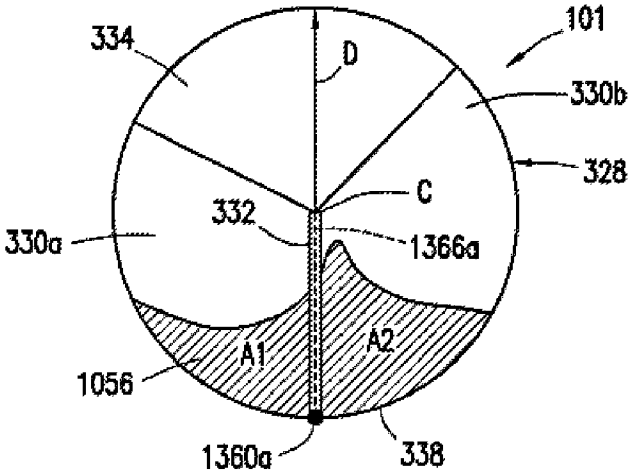
FIGS. 13A-13C are schematic diagrams depicting various centroids defined about a cutting element.
Figure 13B:
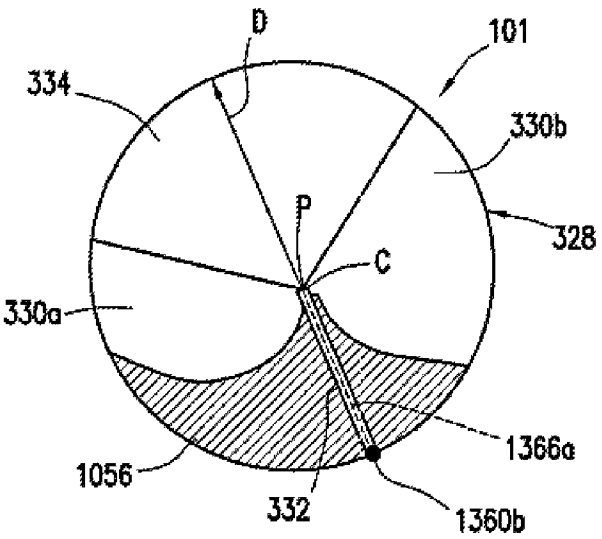
Figure 13C:
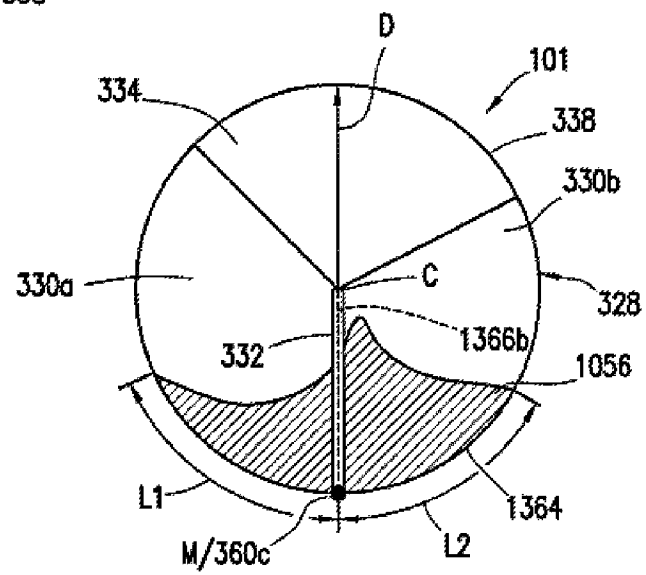

FIGS. 13A-13C depict various techniques for defining centroids 1360*a*-*c* usable in balancing the cutting elements 101. These examples depict the same cutting element 101 as described herein, but may apply to any cutting element structure. FIG. 13A shows a centroid 1360*a* determined based on a divided area technique. FIG. 13B shows a centroid 1360*b* determined based on a peak location technique. FIG. 13C shows a centroid 1360*c* determined based on a shear line technique.

In the example of FIG. 13A, the centroid 1360*a* is defined for the area of cut 1056. The centroid 1360*a* may be defined, for example, by calculating a center of mass of the cutting element. A dividing line 1366*a* is defined to pass through the centroid 1360*a* and to divide the area of cut into two equal areas A1, A2. Dividing line 1366*a* and others disclosed below are examples of what is referred to herein as a "balancing line," which is a line passing through a "balancing feature" of a cutting element and the centroid of the element's area of cut. It is used to individually-balance a cutting element on the bit body. The balancing line also passes through the center of the cutting element's working face. As used herein, the balancing feature is a part of the working surface that lies along the balancing line. It includes ridges (such as ridges 332, 532, 1532, 1632 described herein) as well as other elongate, non-planar features on a working surface, and further includes cutting tips that are disposed along the leading edge of the cutting element, such as at cutting tip 1639 on leading edge 1640 as described below.

The area of cut 1056 may be divided mathematically to provide equal areas A1,A2 on either side of the dividing line 1366*a*. Once the centroid 1360*a* and the dividing line 1366*a* are defined for a given area of cut 1056, the cutting element may be positioned in the bit such that ridge 332 extends along (i.e. is aligned with) the dividing line 1366*a* and passes through the centroid 1360*a* to balance the cutting element 101.

FIG. 13B shows the centroid 1360*b* defined by the radially-innermost peak P of uncut formation that lies within the area of cut of the cutting face or working surface 328. FIG. 13B is similar to FIG. 13A, except that, in this case, the centroid 1360*b* is defined along the dividing line 1366*a* extending through peak P and center C Thus, the centroid 1360*b* is located along the diameter D passing through the center C of the cutting element 101, peak P of the uncut formation within the area of cut, and the ridge 332. To balance the cutting element 101, the cutting element 101 is positioned in the bit such that ridge 332 extends along the dividing line 1366*a* and passes through the centroid 1360*b*.

In FIG. 13C, the centroid 1360*c* is defined at an intersection of a shear line 1364 and a dividing line 1366*b* of the cutting element 101. The shear line 1364 is defined as an arc along the periphery 338 of the working surface 328 about the area of cut 1056. In this case, the dividing line 1366*b* is located by calculating the area of cut 1056, dividing the shear line 1364 into equal lengths L1, L2, and assigning a midpoint M between the lengths L1,L2. The dividing line 1366*b* extends along the diameter D of the cutting element 101 from the midpoint M to the center C. The centroid 1360*c* is positioned along the dividing line 1366*b* at the midpoint M along shear line 1364. To balance the cutting element 101, the cutting element is positioned in the drill bit such that ridge 332 extends along the dividing line 1366*b* and passes through centroid 1360*c*.

While FIGS. 13A-13C depict example techniques for locating centroids and/or balancing cutting elements, any method or technique capable of placing non-planar features along working surfaces 328 of the cutting elements 101 with force distributions and/or balancing of the cutting element and/or the drill bit may be used.

Figure 14:
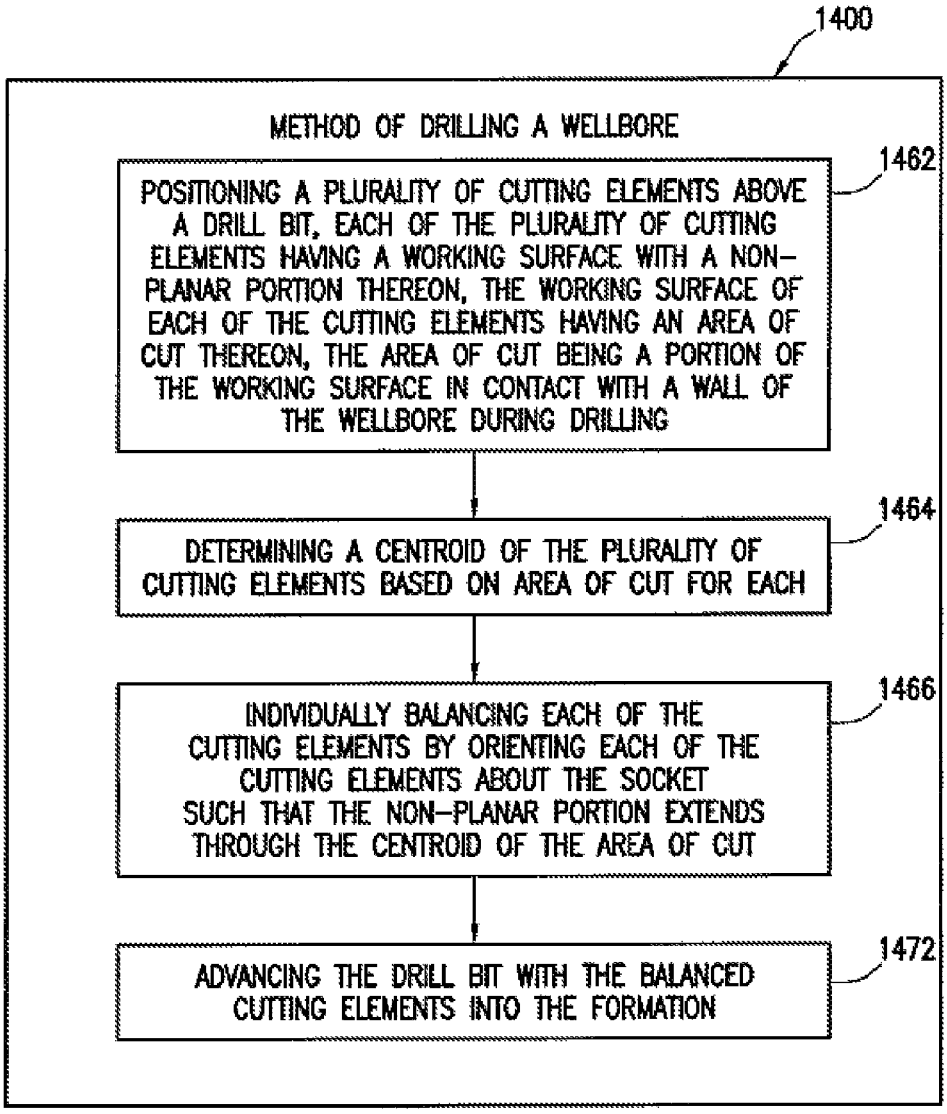
FIG. 14 is a flow chart depicting another method of drilling a wellbore.
Figure 15A:
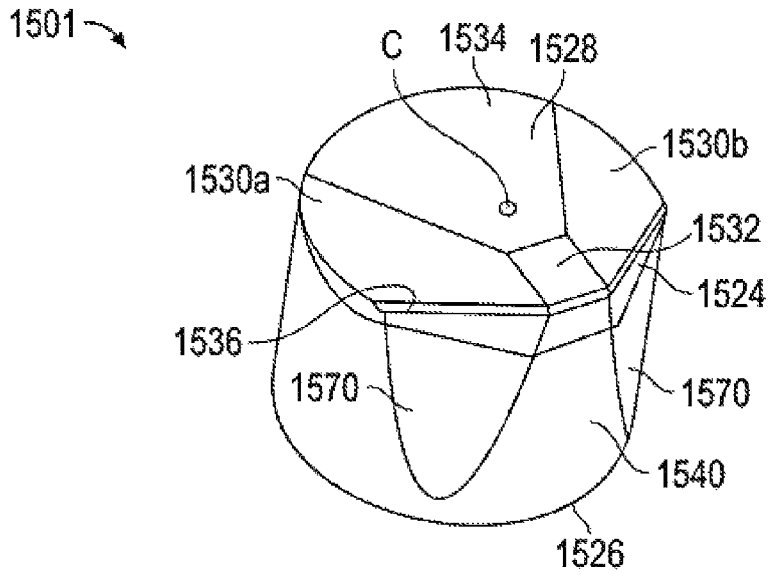
FIGS. 15A-15D are perspective, top, front, and side elevation views, respectively, of a cutting element having an offset configuration and a faceted front, as may be employed in the drill bit of FIG. 9 in a balanced or unbalanced configuration.
Figure 15B:
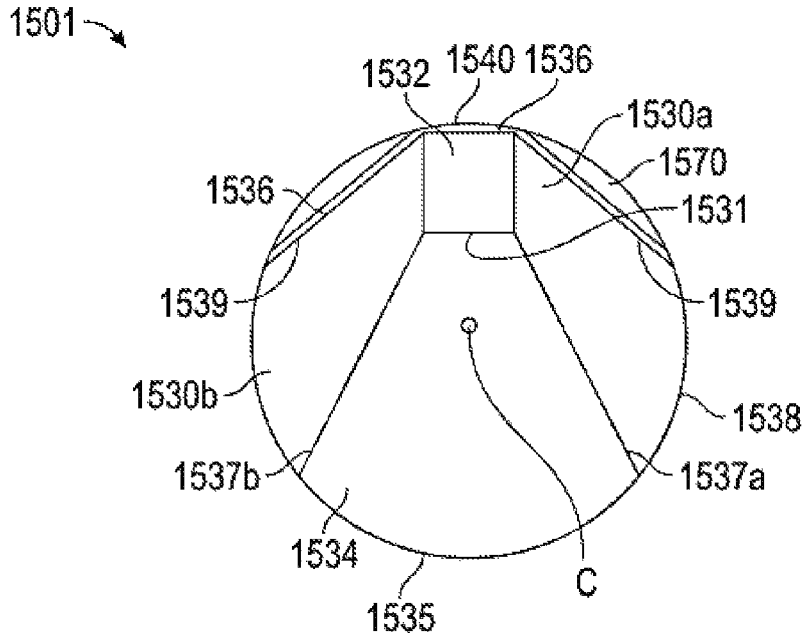
Figure 15C:
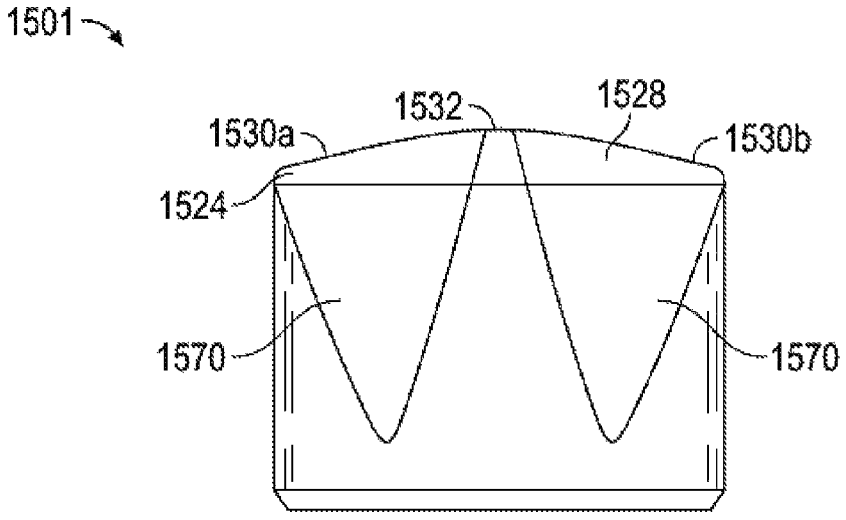
Figure 15D:
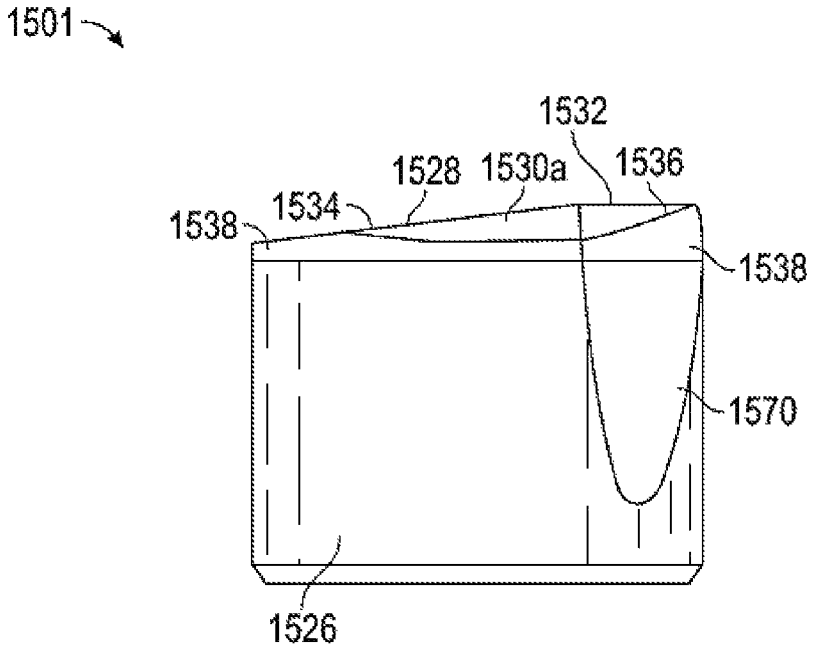

FIG. 14 is a flow chart depicting a method 1400 of drilling a wellbore. The method involves 1462—positioning a plurality of cutting elements about a drill bit, each of the plurality of cutting elements having a working surface with a non-planar portion thereon. The working surface of each of the cutting elements has an area of cut thereon. The area of cut is a portion of the working surface in contact with a wall of the wellbore during drilling. The method further involves 1464—determining a centroid of the area of cut for each of the cutting elements, 1466—individually balancing each of the plurality of cutting elements by orienting each of the cutting elements about the socket such that the non-planar portion extends through the centroid of the area of cut, and 1472—advancing the drill bit with the balanced cutting elements into the formation.

Part or all of the method may be performed for various purposes. The method may be performed in any order and repeated as needed.

Additional Cutting Elements that May be Balanced or Unbalanced

FIGS. 15A-15D depict views of another cutting element 1501 that is suitable for mounting in a socket 220 of bit body 214 of drill bit 112 in place of cutting element 101 shown in FIG. 9. Cutting element 1501 is similar to cutting element 501 previously described, except that it includes a faceted front surface, whereas cutting element 501 was formed without such facets.

In more detail, cutting element 1501 includes a PCD layer 1524 bonded to a less hard substrate 1526. While a single diamond layer 1524 and a single layer of substrate 1526 are depicted, one or more layers of one or more materials may be provided as the PCD layer, the substrate, and/or other portions of the cutting element 1501. When inserted into a socket 220 of the bit body 214 (FIG. 9), cutting element 1501 is positioned with diamond layer 1524 extending outside of the socket 220 and with the cutting face (or working surface) 1528 positioned at the end that is exposed to engage the wellbore and cut formation material as the bit 112 is rotated.

Cutting element 1501 includes a pair of side regions 1530*a,b*, an elongated ridge 1532, a ramp 1534, and a chamfer 1536 disposed on the cutting face 1528, as was described previously with respect to cutting elements discussed above. The side regions (or slanted surfaces) 1530*a,b* are disposed on either side of the ridge 1532 and extend from cutting face periphery 1538 towards the center C.

Ridge 1532 is positioned along a side of each of the side regions 1530*a,b* and separates the side regions 1530*a,b*, which may be symmetrical relative to each other. The ridge 1532 may extend generally perpendicular to leading edge 1540 of the cutting element, and may be centrally oriented along the cutting face 1528. In the embodiment shown in FIGS. 15A-15D, ridge 1532 extends from the leading edge 1540, located at the periphery 1538, towards, but not entirely to, the center C of the cutting face 1528. In this embodiment, ridge 1532 extends for a distance of about ¼ of the diameter of the face 1528. In other embodiments, its length may be from about ¼ to ⅔ of the diameter D of the face 1528. Ridge 1532 may have a length selected for bisecting and physically splitting apart extruding rock particle conglomerates or extrudates and directing the smaller, split extrudate portions into the side regions 1530*a,b*.

Figure 7B:
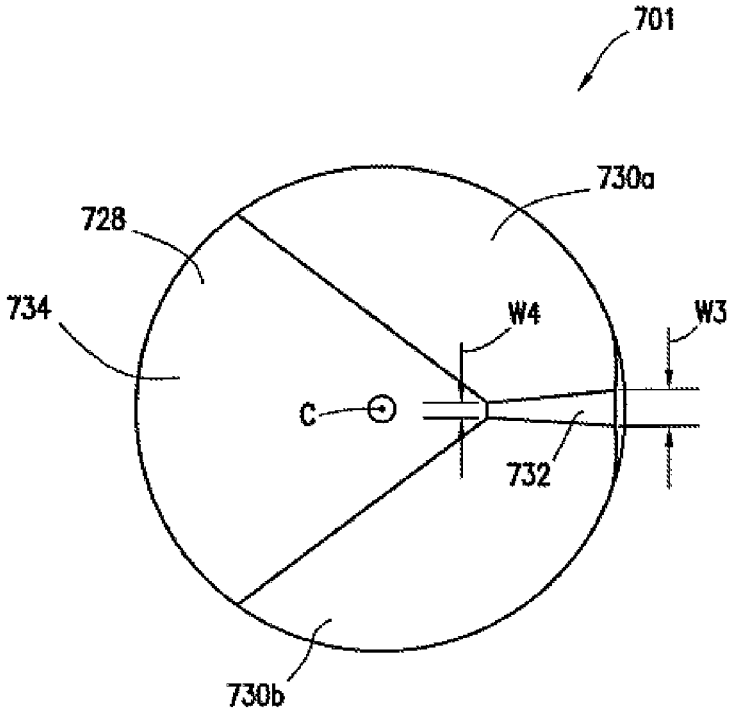

Referring still to FIGS. 15A-15D, ridge 1532 has a uniform width and a uniform height along the entire length thereof. In other embodiments, ridge 1532 may possess a height that varies, such as by increasing from the end that is proximate to the leading edge 1540 to the opposite end 1531 that is located at or near the ramp 1534. Likewise, in some embodiments, ridge 1532 may have a width that varies, such as described above with respect to ridges 632 (FIG. 6B) and 732 (FIG. 7B).

Ramp 1534 defines a region extending from the centralmost end 1531 of the ridge 1532 to periphery 1538, and extending between adjacent side regions 1530*a,b*. Ramp 334 provides a surface to define rigid back support and stability to the side regions 1530*a,b*, and may possess the ramp angle and incline angle of any of the cutting elements previously described, such as cutting element 101.

In the embodiment shown in FIGS. 15A-15D, ramp 1534 has a curved edge 1535 along a periphery of the cutting face, and two sides 1537*a,b*. Each of the two sides 1537*a,b* extends from opposite ends of the curved edge 1535 and each converges toward the other until they meet the centralmost end 1531 of ridge 1532. Each of the pair of side regions 1530*a,b* is positioned on an opposite side of the ridge 1532, and each extends between the periphery 1538, the ridge 1532, and one of the two sides 1537*a,b* of ramp 1534.

Cutting element 1501 further includes a pair of generally planar surfaces or facets 1570. As best show in top view of FIG. 15B, one facet 1570 is located on each side of ridge 1532 and each extends through the diamond layer 1524 and partially through the substrate 1526. In this manner, the periphery 1538 of the cutting surface is not entirely circular, but instead includes two linear edges 1539 formed at the intersection of a side region 1530*a,b* and the generally planar facet 1570. Edges 1539 are chamfered, as explained below.

Cutting element 1501 further includes chamfer 1536. In the embodiment shown, chamfer 1536 extends from the ridge 1532 at a chamfer angle of about 45 degrees. In other embodiments, the chamfer angle may be from about 15 degrees to about 75 degrees. Chamfer 1536 extends along the outermost edge (i.e. peripheral end) of ridge 1532, thereby forming the leading (or cutting) edge 1540. Leading edge 1540 may be dimensioned to achieve a generally predetermined depth-of-cut into the rock formation. By extending the ridge 1532 to the periphery 1538 of the cutting element 1501, the side regions 1530*a,b* and the ridge 1532 provide a chamfered leading edge 1540 selected for splitting of the rock particle conglomerates or extrudates. Chamfer 1536 also extends along each linear intersection of a side surface 1530*a,b* with a facet 1570.

Figure 16:
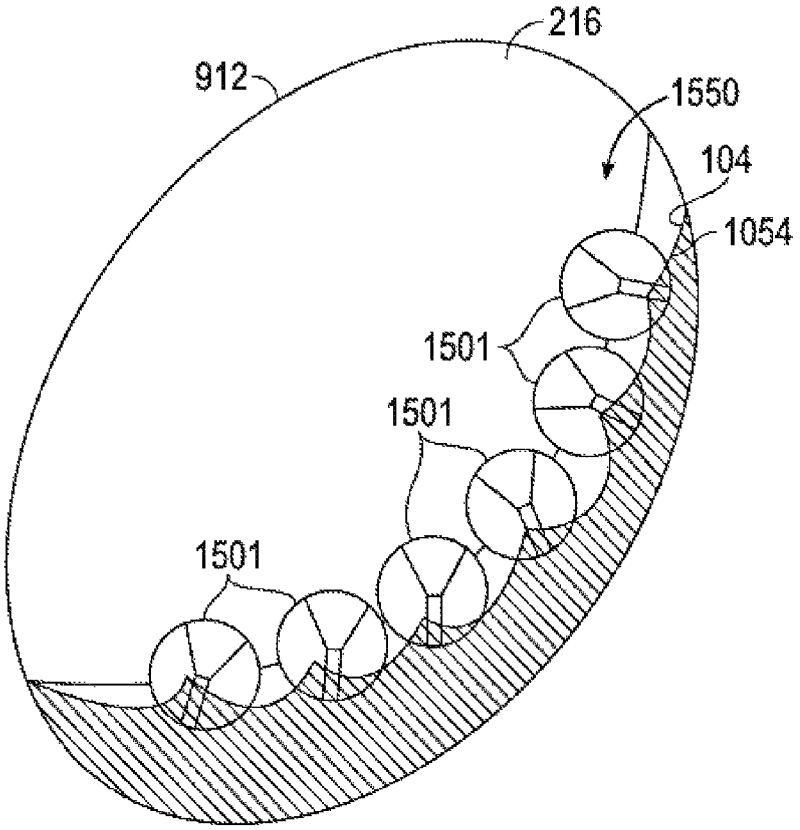
FIG. 16 is a detailed view of a portion of the drill bit of FIG. 9 having the cutting elements of FIGS. 15A-15D mounted in a balanced configuration.

Cutting elements 1501 may be mounted in a drill bit 112 in balanced or unbalanced (i.e. random) configurations. In the balanced configuration, some or all of the cutting elements 1501 mounted in a segment of the bit, such as on a given rib 216 (FIG. 9), may be balanced. FIG. 16 shows a plurality or group 1550 of cutting elements 1501 positioned in 'balanced' configuration in the bit of FIG. 9 based on each cutting element's the area of cut 1056 (previously described with reference to FIG. 11B). In this embodiment, the ridges 1532 of cutting elements 1501 are positioned about the rib 216 for engagement with the wall of the wellbore 104 and are balanced with respect to the area of cut 1056. A centroid 1060 of the area of cut 1056 is defined for each cutting element 1501 based on its position about the rib 216. Cutting element 1501 is mounted in rib 216 such that the ridge 1532 extends through the centroid 1060 defined for each cutting element 1501. Because each of the cutting elements 1501 has a different area of cut 1056 (based on its location along the bit profile), and therefore has a different location for its centroid 1060, ridge 1532 may be located in a different position along the working surface 1528 of each of the cutting elements 1501 depending on its area of cut 1056. The ridge 1532 (and/or other non-planar feature) of each cutting element 1501 is positioned along the working surface 1528 so as to align with the centroid 1060, as described in more detail below.

Figure 17A:
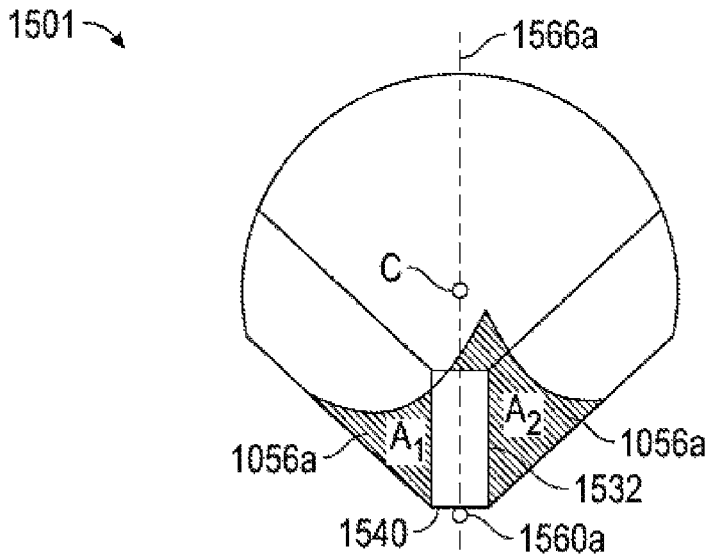
FIGS. 17A-17C are schematic diagrams depicting various centroids defined about the cutting element of FIGS. 15A-15D.
Figure 17B:
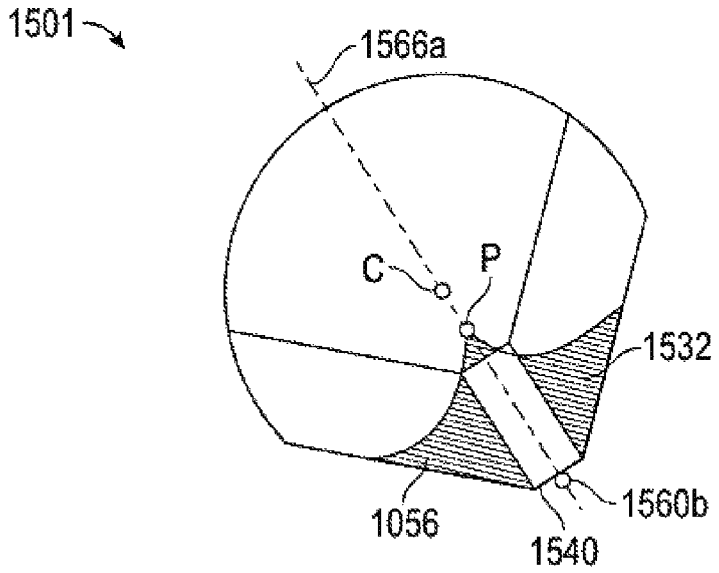
Figure 17C:
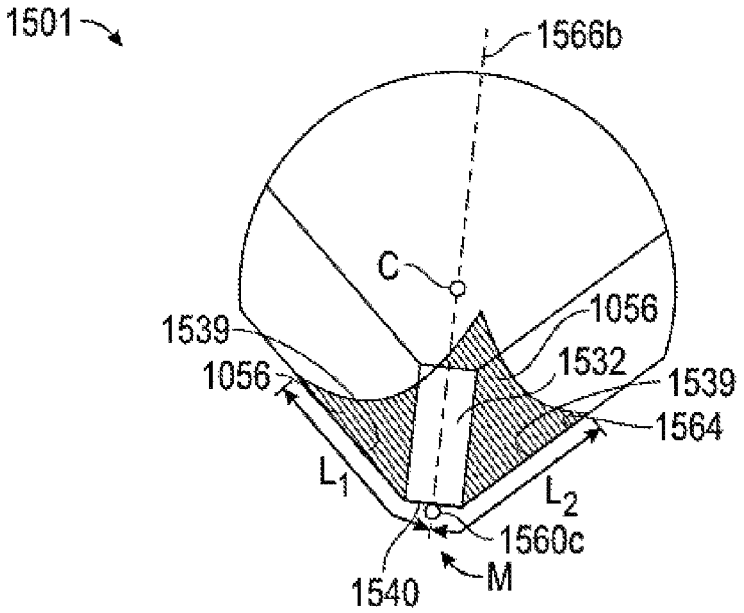

FIGS. 17A-17C depict various techniques for defining centroids 1560*a-c* usable in balancing the cutting elements 1501. These examples depict the same cutting element 1501 as described herein, but they may apply to any cutting element structure. FIG. 17A shows a centroid 1560*a* that is determined based on a divided area technique. FIG. 17B shows a centroid 1560*b* determined based on a peak location technique. FIG. 17C shows a centroid 1560*c* determined based on a shear line technique.

In the example of FIG. 17A, the centroid 1560*a* is defined for the area of cut 1056*a*. The centroid 1560*a* may be defined, for example, by calculating a center of mass of the cutting element. A dividing line 1566*a* is defined to pass through the centroid 1560*a* and to divide the area of cut into two equal areas A1, A2. Dividing line 1566*a* is a balancing line as may be used to individually balance cutting element 1501.

The area of cut 1056*a* may be divided mathematically to provide equal areas A1,A2 on either side of the dividing line 1566*a*. Once the centroid 1560*a* and the dividing line 1566*a* are defined for a given area of cut 1056*a*, the cutting element is positioned in the bit such that ridge 1532 is positioned extends along (i.e. is aligned with) the dividing line 1566*a* and passes through the centroid 1560*a* to balance the cutting element 1501.

FIG. 17B shows the centroid 1560*b* defined at the peak (or highest) point P of the working surface 1528. FIG. 17B is similar to FIG. 17A, except that, in this case, the centroid 1560*b* is defined along the dividing line 1566*a* at the highest point along the cutting element 1501. In this case, the highest point is adjacent the most central end of ridge 1532. Thus, the centroid 1560*b* is located along the diameter D passing through the center C of the cutting element 1501 and the ridge 1532. To balance the cutting element 1501, it is positioned such that ridge 1532 extends along (i.e. is aligned with) the dividing line 1566*a* and passes through the centroid 1560*b* to balance the cutting element 1501.

In FIG. 17C, the centroid 1560*c* is defined at an intersection of a shear line 1564 and a dividing line 1566*b* of the cutting element 1501. The shear line 1564 is defined as a segmented, arcuate-like portion of the periphery 1538 of the working surface 1528 as made up by edges 1539 and by leading edge 1540. In this case, the dividing line 1566*b* is located by calculating the area of cut 1056, dividing the shear line 1564 into equal lengths L1, L2, and assigning a midpoint M between the lengths L1, L2. The dividing line 1566*b* extends along the diameter D of the cutting element 1501 from the midpoint M to the center C. The centroid 1560*c* is positioned along the dividing line 1566*b* at the midpoint M along shear line 1564. To balance the cutting element 1501, the cutting element 1501 is positioned in the bit such that ridge 1532 is positioned along the dividing line 1566*b* and passes through centroid 1560*c*.

While FIGS. 17A-17C depict exemplary techniques for locating centroids and/or balancing cutting elements, any method or technique capable of placing non-planar features along working surfaces 1528 of the cutting elements 1501 with force distributions and/or balancing of the cutting element and/or the drill bit may be used.

Figure 18A:
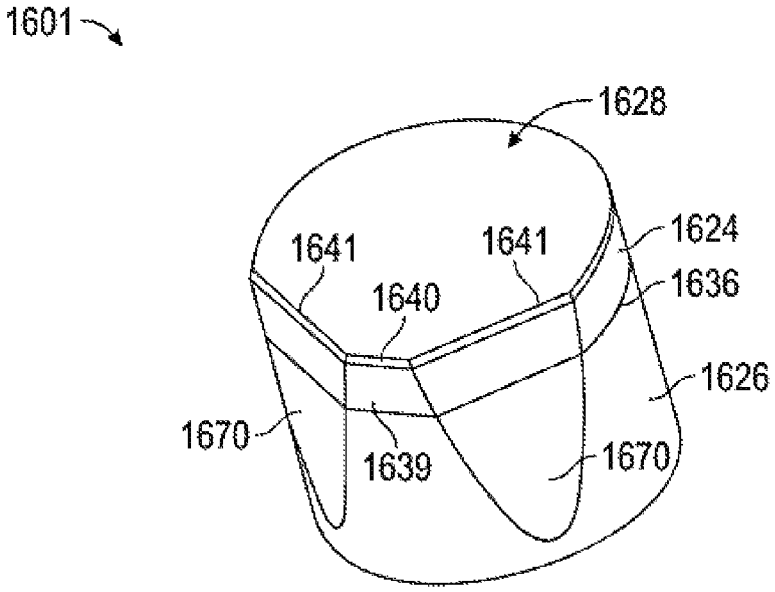
FIGS. 18A-18C are perspective, top and front elevation views, respectively, of another cutting element having a faceted front, as may be employed in the drill bit of FIG. 9 in a balanced or unbalanced configuration.
Figure 18B:
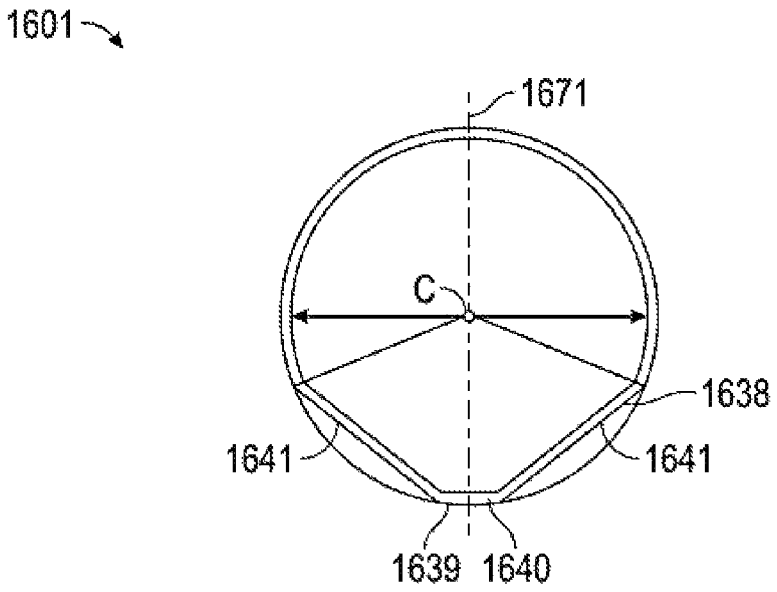
Figure 18C:
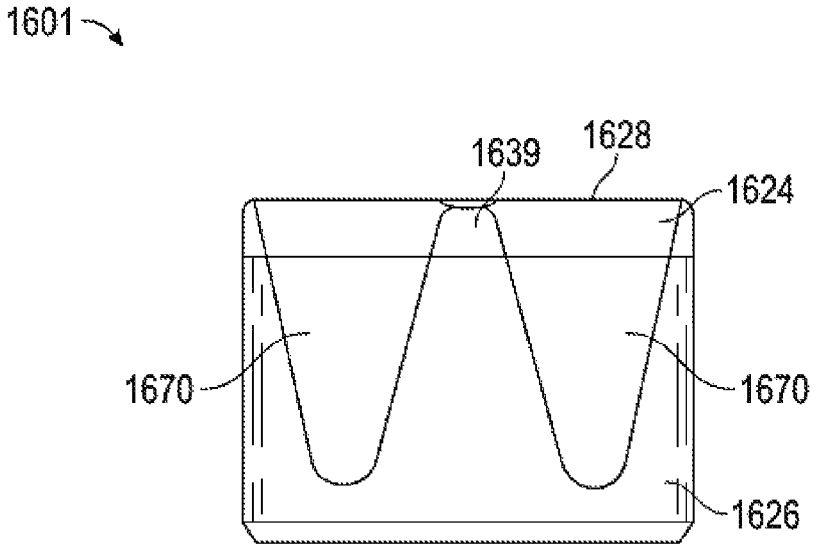

FIGS. 18A-18C depict views of another cutting element 1601 that is suitable for mounting in a socket 220 of bit body 214 of drill bit 112 in place of cutting element 101 that is shown in FIG. 9. Cutting element 1601 is similar to cutting element 1501 previously described, as each includes a faceted front; however, cutting element 1601 has a generally planar working surface, and thus does not include a ridge, ramp or side regions as was described with reference to cutting element 1501.

In more detail, cutting element 1601 includes a PCD layer 1624 bonded to a less hard substrate 1626. When inserted into a socket 220 of the bit body 214 (FIG. 9), cutting element 1601 is positioned with diamond layer 1624 extending outside of the socket 220 and with the generally planar cutting face 1628 positioned at the end that is exposed to engage the wellbore and cut formation material as the bit 112 is rotated.

Cutting element 1601 further includes a pair of generally planar surfaces or facets 1670. As best show in top view of FIG. 18B, one facet 1670 is located on each side of a bisecting line 1671, and each extends through the diamond layer 1624 and partially through the substrate 1626. The cutting face 1628 further includes a cutting tip 1639 positioned at the leading edge 1640. Bisecting line 1671 passes through the geometric center C of the circular foot print that is formed by cutting element 1601, and it intersects the cutting tip 1639 and bisects the leading edge 1640. As used herein, the term "bisecting line" is another example of a "balancing line" which is used to individually-balance cutting elements on the bit body. The design and dimensions of cutting tip 1639 and leading edge 1640 may be chosen to achieve a generally predetermined depth-of-cut into the rock formation and for splitting of the rock particle conglomerates or extrudates. Given this geometry, the periphery 1638 of the cutting face 1628 is not entirely circular, but instead includes two linear edges 1641 that are formed at the intersection of a facet 1670 and planar cutting face 1628.

Cutting element 1601 further includes chamfer 1636. In the embodiment shown, chamfer 1636 extends along the entire outermost edge of cutting face 1628, including along each linear edge 1641 and along leading edge 1640. The chamfer angle may be about 45 degrees or another measure.

Figure 19A:
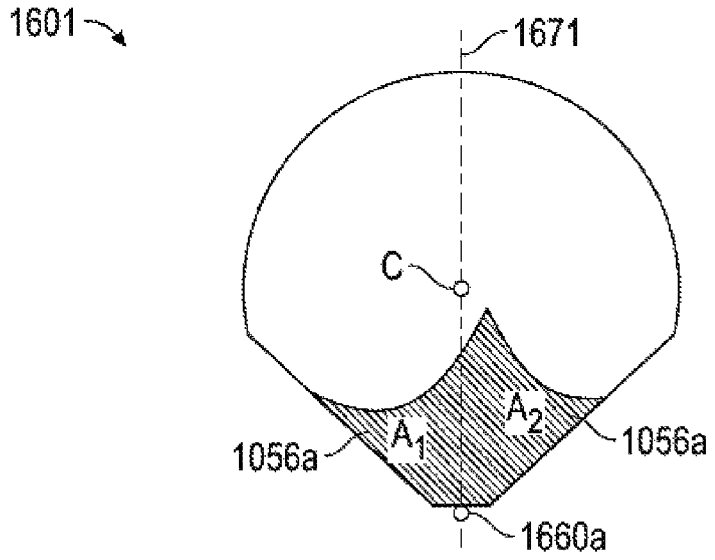
FIGS. 19A-19C are schematic diagrams depicting various centroids defined about the cutting element of FIGS. 18A-15C.
Figure 19B:
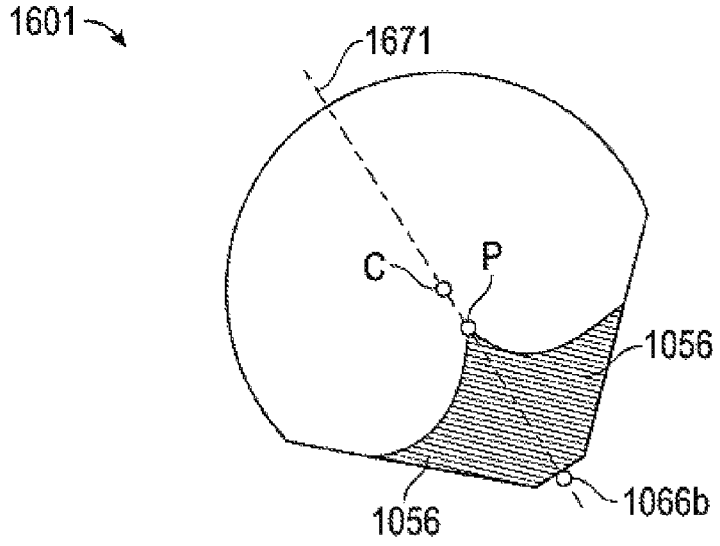
Figure 19C:
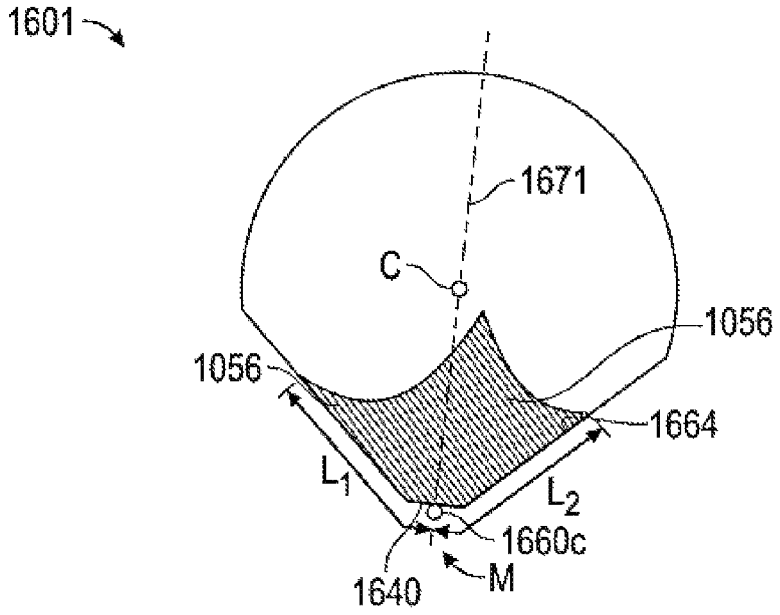

Cutting elements 1601 may be mounted in a drill bit 112 in balanced or unbalanced (i.e. random) configurations. In the balanced configuration, some or all of the cutting elements 1601 mounted in a segment of the bit, such as on a given rib 216 (FIG. 9), may be balanced. FIGS. 19A-19C depict various techniques for defining centroids 1660*a-c* usable in balancing the cutting elements 1601. FIG. 19A shows a centroid 1660*a* that is determined based on a divided area technique. FIG. 19B shows a centroid 1660*b* determined based on a peak location technique. FIG. 19C shows a centroid 1660*c* determined based on a shear line technique.

In the example of FIG. 19A, the centroid 1660*a* is defined by using the area of cut 1056*a*. The centroid 1660*a* may be defined, for example, by calculating a center of mass of the cutting element. Bisecting line 1671 is defined to pass through the centroid 1660*a* and to divide the area of cut 1056*a* into two equal areas A1, A2.

The area of cut 1056*a* may be divided mathematically to provide equal areas A1, A2 on either side of the bisecting line 1671. Once the centroid 1560*a* and the bisecting line 1671 are defined for a given area of cut 1056*a*, the cutting element is positioned in the bit such that bisecting line 1671 passes through the centroid 1560*a* to balance the cutting element 1601.

FIG. 19B shows the centroid 1660*b* defined in relation to the highest peak P (i.e. the radially-innermost peak) of uncut formation that is within the area of cut 1056 being removed by the working surface 1628. FIG. 19B is similar to FIG. 19A, except that, in this case, the centroid 1660*b* is defined along the bisecting line 1671 that passes through the peak P. Thus, the centroid 1660*b* is located along the diameter D passing through peak P and the center C of the cutting element 1601. To balance the cutting element 1601, it is positioned such that the bisecting line 1671 passes through point P and the centroid 1660*b* to balance the cutting element 1601.

In FIG. 19C, the centroid 1660*c* is defined at an intersection of shear line 1664 and a bisecting line 1671 of the cutting element 1601. The shear line 1664 is defined as a segmented, arcuate-like portion of the periphery 1638 of the working surface 1628, as made up by edges 1641 and by leading edge 1640. In this case, the bisecting line 1671 is located by calculating the area of cut 1056, dividing the shear line 1664 into equal lengths L1, L2, and assigning a midpoint M between the lengths L, L2. The bisecting line 1671 extends along the diameter D of the cutting element 1601 from the midpoint M to the center C. The centroid 1660*c* is positioned along the bisecting line 1671 at the midpoint M along shear line 1664. To balance the cutting element 1601, the cutting element 1601 is positioned in the bit such that bisecting line 1671 passes through midpoint M and centroid 1660*c*.

While the subject matter has been described with respect to a limited number of exemplary embodiments, those skilled in the art, having benefit of this disclosure, will appreciate that other embodiments can be devised which do not depart from the scope of the subject matter as disclosed herein. Accordingly, the scope of the invention should be limited only by the attached claims.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and/or other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

The above description is illustrative of exemplary embodiment and many modifications may be made by those skilled in the art without departing from the invention whose scope is to be determined from the literal and equivalent scope of the claims that follow.

While the embodiments are described with reference to various implementations and exploitations, it will be understood that these embodiments are illustrative and that the scope of the inventive subject matter is not limited to them. Many variations, modifications, additions and improvements are possible, such as such as location, shape, dimensions, and orientation of the regions, ridge, ramp, chamfer, etc. and materials used in their manufacture. One or more cutting elements may be provided with various features and/or oriented according to various configurations. Various combinations of the features provided herein may be utilized.

What is claimed is:

1. A drill bit advanceable into a subterranean formation to form a wellbore, the drill bit comprising:

a bit body having a plurality of cylindrical sockets configured to receive cutting elements;

a plurality of cutting elements configured to be mounted in the sockets, wherein each of the plurality of cutting elements comprises a cylindrical base portion and a working surface attached to the base portion, the working surface comprising a balancing feature, a center, a periphery, and a balancing line that passes through the balancing feature and passes through the center of the working surface;

wherein each of the cutting elements of the plurality is mounted in a socket in the bit body so that the working surface of the cutting element is positioned to cut formation material in an area of cut and such that: (1) the balancing line divides the area of cut into equal areas on either side of the balancing line: or (2) the balancing line intersects the radial-innermost peak of uncut formation that lies within the area of cut: or (3) the balancing line divides that portion of the periphery of the working surface that engages the area of cut into two equal lengths.

2. The drill bit of claim 1 wherein the working surface of the cutting elements of the plurality further comprises:

a pair of side regions and a ramp between the side regions, the ramp having a curved edge along a periphery of the working surface and having two ramp sides, each of the two ramp sides extending from opposite ends of the curved edge and meeting at a convergence location;

an elongate non-planar feature on the working surface extending from the convergence location along the balancing line, each of the pair of side regions being positioned on opposite sides of the balancing line and extending between the periphery of the working surface, the elongate non-planar feature, and one of the two ramp sides.

3. The drill bit of claim 2 wherein the cutting elements of the plurality further comprise a pair of facets and a cutting tip disposed between the facets, and wherein the balancing line bisects the cutting tip.

4. The drill bit of claim 1 wherein the cutting elements of the plurality further comprise a pair of facets and a cutting tip disposed between the facets; and wherein the balancing line bisects the cutting tip; and wherein the working surface is planar.

5. The drill bit of claim 1 further comprising:

a plurality of extending ribs on the bit body; and wherein each of the cutting elements of the plurality is fixed within the same one of the ribs.

6. The drill bit of claim 1 wherein the balancing feature is an elongate ridge.

7. The drill bit of claim 1 wherein the cutting elements of the plurality further comprise a pair of facets and a cutting tip disposed between the facets, and wherein the balancing feature is the cutting tip.

8. The drill bit of claim 1 wherein the balancing line of at least a first cutting element of the plurality extends along a line that divides the area of cut into two regions having equal areas.

9. The drill bit of claim 1 wherein the working surface of at least one of the cutting elements of the plurality includes a shearing edge; and wherein the cutting element is fixed in the bit body such that the balancing line of the cutting element extends along a line that divides the shearing edge into two segments of equal length.

10. The drill bit of claim 1 wherein at least one of the cutting elements of the plurality is fixed in the bit body such that the balancing line extends along a line that intersects the radially-innermost peak of uncut formation that lies in the area of cut.

11. The drill bit of claim 1 further comprising:

at least a first rib on the bit body extending therefrom;

wherein each of the plurality of cutting elements is mounted on the first rib; and wherein less than all of the plurality of cutting elements on the first rib are positioned such that the balancing line intersects the peak of uncut formation that lies within the area of cuts.

12. The drill bit of claim 6 further comprising:

at least a first rib on the bit body extending therefrom;

wherein each of the plurality of cutting elements is mounted on the first rib; and wherein less than all of the plurality of cutting elements on the first rib are positioned such that the ridge extends along a line that divides the area of cut into two regions having equal areas.

13. The drill bit of claim 6 further comprising:

at least a first rib on the bit body extending therefrom;

wherein each of the cutting elements of the plurality is mounted on the first rib; and wherein less than all of the cutting elements on the first rib are positioned such that the ridge extends along the balancing line and the balancing line divides that portion of the periphery of the working surface that engages the area of cut into two segments of equal length.

14. The drill bit of claim 6 further comprising:

at least a first rib on the bit body extending therefrom;

wherein each of the cutting elements of the plurality is mounted on the first rib; and wherein less than all of the plurality of cutting elements on the first rib are positioned such that the ridge extends along a line that intersects the radially-innermost peak of uncut formation that lies in the area of cut.

15. A method of making a drill bit comprising:

forming a bit body having cylindrical sockets configured to receive cutting elements;

forming a plurality of cutting elements for mounting in the sockets, wherein each of the plurality of cutting elements comprises a cylindrical base portion and a working surface attached to the base portion, the working surface comprising a balancing feature and a balancing line that passes through the balancing feature and passes through the center of the working face;

mounting each of the cutting elements of the plurality in a socket in the bit body so that the working surface of the cutting element is configured to cut formation material in an area of cut;

determining a centroid for the area of cut for each of the plurality of cutting elements;

for each of the cutting elements of the plurality, positioning the cutting element in one of the sockets so that the balancing line of the cutting element passes through the centroid of the area of cut.

16. The method of claim 15 wherein the cutting elements of the plurality include an elongate ridge on the working surface, and where the balancing line is aligned with the elongate ridge.

17. The method of claim 15 wherein the cutting elements of the plurality include a pair of facets and a cutting tip disposed between the facets, and wherein the balancing line bisects the cutting tip.

18. The method of claim 15 further comprising positioning at least a first cutting element of the plurality in the bit body such that the balancing line of the cutting element extends along a line that divides the area of cut into two regions having equal areas.

19. The method of claim 15 further comprising forming the working surface of the plurality of cutting elements to include a shearing edge, and fixing at least a first cutting element of the plurality in the bit body such that the balancing line extends along a line that divides the shearing edge into two segments of equal length.

20. The method of claim 15 further comprising:

determining the position of the peaks of formation material that will be acted upon by each of the cutting elements of the plurality when the cutting element engages the formation material and removes its area of cut;

fixing at least a first cutting element of the plurality in the bit body such that the balancing line extends along a line that intersects the radially-innermost peak of uncut formation that lies in the area of cut.

21. The method of claim 15 wherein determining a centroid comprises using a technique selected from the group consisting of divided area technique, peak location technique, and shear line technique.

22. The method of claim 21 further comprising using a first technique to determine the centroid for a first of the cutting elements of the plurality, and using a second technique that is different than the first technique to determine the centroid for a second of the cutting elements of the plurality.

* * * * *